US011505420B2

(12) United States Patent
Aprato et al.

(10) Patent No.: US 11,505,420 B2
(45) Date of Patent: Nov. 22, 2022

(54) HIGH SPEED DIGITAL PRINTING SYSTEM AND METHOD FOR CONTINUOUS WEB

(71) Applicant: TECNAU S.r.l., Ivrea (IT)

(72) Inventors: Armando Aprato, Ivrea (IT); Giuliano De Marco, Ivrea (IT); Marco Andreuccetti, Ivrea (IT)

(73) Assignee: TECNAU S.r.l.

( * ) Notice: Subject to any disclaimer, the term of this patent is extended or adjusted under 35 U.S.C. 154(b) by 340 days.

(21) Appl. No.: 16/907,285

(22) Filed: Jun. 21, 2020

(65) Prior Publication Data

US 2020/0399086 A1 Dec. 24, 2020

(30) Foreign Application Priority Data

Jun. 21, 2019 (IT) ..... 102019000009822

(51) Int. Cl.
*B65H 21/02* (2006.01)
*B41J 15/16* (2006.01)
(Continued)

(52) U.S. Cl.
CPC ..... *B65H 21/02* (2013.01); *B41J 15/16* (2013.01); *B65H 16/00* (2013.01); *B65H 18/08* (2013.01);
(Continued)

(58) Field of Classification Search
CPC ..... B65H 21/02; B65H 16/00; B65H 18/08; B65H 2301/46011; B65H 18/021;
(Continued)

(56) References Cited

U.S. PATENT DOCUMENTS 4,374,576 A 2/1983 Ryan
2010/0264248 A1* 10/2010 Butterworth ..... B65H 19/1847 242/554
(Continued)

FOREIGN PATENT DOCUMENTS

DE 3744002 A1 7/1989
EP 0099732 A2 2/1984
(Continued)

*Primary Examiner* — Randy W Gibson
*Assistant Examiner* — John M Royston
(74) *Attorney, Agent, or Firm* — Loginov & Associates, PLLC; William A. Loginov

(57) ABSTRACT

A high-speed digital printing system includes two unwinding machines for two input coils for a paper web, an input unwinding and splicing installation and a printing station and in which the input installation supplies, in turn, the printing station with the web of the two coils. The system also includes a splicing and rewinding installation with an output cutting and splicing equipment for an incoming web emerging from the printing station and two rewinding machines with two output coils. The output equipment feeds alternatively the rewinding machines with the incoming web by cutting and splicing of a web of the two output coils without stopping printing. An electronic controller switches the functionality of the output cutting and splicing equipment and of the rewinding machines with setting of the output coils as an operating coil and a waiting coil and, viceversa, as a waiting coil and an operating coil.

20 Claims, 12 Drawing Sheets

(51) Int. Cl.

| | |
|---|---|
| ***B65H 16/00*** | (2006.01) |
| ***B65H 18/08*** | (2006.01) |
| ***B65H 19/26*** | (2006.01) |
| ***B65H 18/02*** | (2006.01) |
| ***B65H 19/18*** | (2006.01) |

(52) U.S. Cl.
CPC ..... *B65H 18/021* (2013.01); *B65H 19/1852* (2013.01); *B65H 19/1873* (2013.01); *B65H 19/26* (2013.01); *B65H 2301/46011* (2013.01); *B65H 2301/4621* (2013.01); *B65H 2301/46312* (2013.01); *B65H 2404/1152* (2013.01); *B65H 2801/15* (2013.01)

(58) Field of Classification Search
CPC ..... B65H 19/26; B65H 2301/4621; B65H 2301/46312; B65H 19/1852; B65H 19/1873; B65H 2404/1152; B65H 2801/15; B41J 15/16
See application file for complete search history.

(56) References Cited

U.S. PATENT DOCUMENTS

| | | | | |
|---|---|---|---|---|
| 2016/0244290 | A1* | 8/2016 | De Marco | B65H 19/1852 |
| 2020/0262219 | A1* | 8/2020 | Vachhani | B41J 3/407 |

FOREIGN PATENT DOCUMENTS

| | | | |
|---|---|---|---|
| EP | 3059194 | A2 | 8/2016 |
| IT | 1428679 | | 8/2016 |
| WO | 2015008208 | A2 | 1/2015 |

* cited by examiner

HIGH SPEED DIGITAL PRINTING SYSTEM AND METHOD FOR CONTINUOUS WEB

RELATED APPLICATION

This application claims priority to Italian Application No. 102019000009822 filed Jun. 21, 2019, and entitled High Speed Digital Printing System and Method for Continuous Web, the content of which is incorporated herein by reference in its entirety.

FIELD OF THE INVENTION

The present invention relates to a systems and a methods of digital printing at high speed for a continuous web, and more particularly to systems for utilizing continuous paper web comprising two unwinding machines with two feeding coils of the web, an input cutting and splicing equipment and a printing station and in which the input cutting and splicing equipment feeds in turn the printing station with the web of the two coils for printing onto a web in output.

BACKGROUND OF THE INVENTION

A digital printing system with a web unwinding and splicing installation of this type is described in the Italian Patent N. 1.428.679 (and corresponding European Patent EP 3 059 194) in the name of the Applicant Tecnau Srl. This system allows the printing station to be fed without interruptions from a coil to another when a coil is exhausted and to switch, on request, the supply coil, rapidly and in a way relatively inexpensively, and forming a printed web with sections having different typologies.

For digital printing systems that operate offline at high speed, the printed web is wound in large output coils, then employed by user installations, manufacturing, for example book on demand or large quantities of mail, tax or accounting documents. The user installations are optimized for operating with printed web coils having uniform characteristics and this requires that the printing systems of origin form coils having characteristics congruent with the treated typology.

On the other hand, the request emerged to produce books or brochures made from paper of a given weight or color, alternating with books or brochures made of paper of different weights or colors. The printing system must therefore provide coils of a same typology by replacing the coils, regardless of their degree of winding. The removal of the coils and their replacement can last up to fifteen minutes and with the current systems that print a coil in about one hour, the downtime percentage due to these operations can affect about 25% of the operating cycle.

A splicing and rewinding installation with two coils which avoids printer stops when an operating coil is completely full is known from U.S. Pat. No. 4,374,576. In this installation, an edge of the web of the waiting coil is prepared manually with an adhesive and held on a retaining member of a cutting and splicing unit. Upon reaching the maximum capacity, the operating coil and the web to be rewound are stopped, the web is transversely cut and an edge is glued on the edge of the web held by the retention member. In sequence, the waiting coil is put into rotation as a new operating coil, while the edge of the full coil is left inactive for the removal of the coil itself, to be replaced with an empty coil.

A requirement of some high-speed digital printing systems also concerns the execution of work orders of an urgent nature received, for example, during the execution of work orders already set. Unless additional printing lines intended for this purpose are provided, the urgent works would be printed on the operating coil together with the work orders already set and would be carried out only after the complete rewinding of the coils and their movement into the user installation.

A general problem of digital printing systems with rewinding in coil is related to the fact that, in the case of interruption of printing caused by malfunctions, the section of empty or defective web is rewound together with the sections regularly printed and must be removed. Moreover, if the rewinding coil reaches a full condition before completing a given work, it would disadvantageously be printed in two different coils.

In industrial printing systems, the use of inkjet printers is widespread. This technology, ensures high speed and excellent quality of printing, but requires periodic calibration phases and purging of the nozzles, for example in a programmed way, after printing of some coils. This gives rise, in the entering web, to waste sections rewound along with the other sections and to be eliminated.

Current digital printing systems operate with web feed speeds of 150 m/min and above, and sections of web empty or defective rewound in the coils can extend for some tens of meters. This creates problems and wasted time in the user installation for discarding the unusable sections of the web.

A splicing and rewinding installation of the type disclosed in U.S. Pat. No. 4,374,576 is not able to solve the aforementioned problems of high speed digital printing systems.

SUMMARY OF THE INVENTION

The present invention desirably overcomes disadvantages of the prior art by providing a system and a method of high speed digital printing for continuous web in a reliable and high velocity way which allows to rewind the printed web in homogeneous coils and to treat malfunctions and work orders with prints of different nature.

In accordance with this desirable objective, the high-speed digital printing system for continuous paper web comprises a web splicing and rewinding installation, which includes an output cutting and splicing equipment, two rewinding machines with two respective output coils and an electronic controller. The controller is provided for switching the functionality of the output cutting and splicing equipment and of the rewinding machines from a reference configuration to a switched configuration by setting the output coils as operative coil and waiting coil and to restore the functionality of the output cutting and splicing equipment and of the rewinding machines to the reference configuration.

The high-speed digital printing method for continuous web of the invention provides the use of a digital printing system comprising two unwinding machines with two feeding coils of input webs, an input cutting and junction equipment and a printing station, and in which the input cutting and splicing equipment feeds, in turn, the printing station with the web of the two coils for printing on an outgoing web. The used system further comprises an output cutting and splicing equipment, two rewinding machines with two respective output coils, and electronic means for detecting reference operating conditions or modified operating conditions of the system. In particular, the printing method includes the steps: (a) upon detection of the modified operating conditions of the system, activating the output cutting and splicing equipment and switching the functionality of the rewinding machines from a reference configuration to a switched configuration without stopping the printing, with setting of the output coils from operating coil to waiting coil; (b) switching the functionality of the output cutting and splicing equipment from a reference configuration to a switched configuration in association with the switched configuration of the rewinding machines; (c) upon detection of the reference operating conditions, activating the output cutting and splicing equipment and switching the functionality of the rewinding machines from the switched configuration to the reference configuration, with setting of the output coils from coil in standby to operating coil; and (d) switching the functionality of the output cutting and splicing equipment from the switched configuration to the reference configuration in association with the reference configuration of the rewinding machines.

The system and the printing method of the invention allow printing without interruption on continuous paper webs and rewinding in coil with: automatic replacement in full conditions of the coils; rewinding for homogenous typologies; optimal management of emergencies and formation of coils without printing defects and/or voids, even in the event of jamming of the system.

BRIEF DESCRIPTION OF THE DRAWINGS

The characteristics of the invention will become clear from the following description, given purely by way of non-limiting example, with reference to the accompanying drawings, in which:

FIG. 7 shows a schematic view of the equipment of FIG. 4 in a fourth operating configuration, while

DETAILED DESCRIPTION

Figure 1:
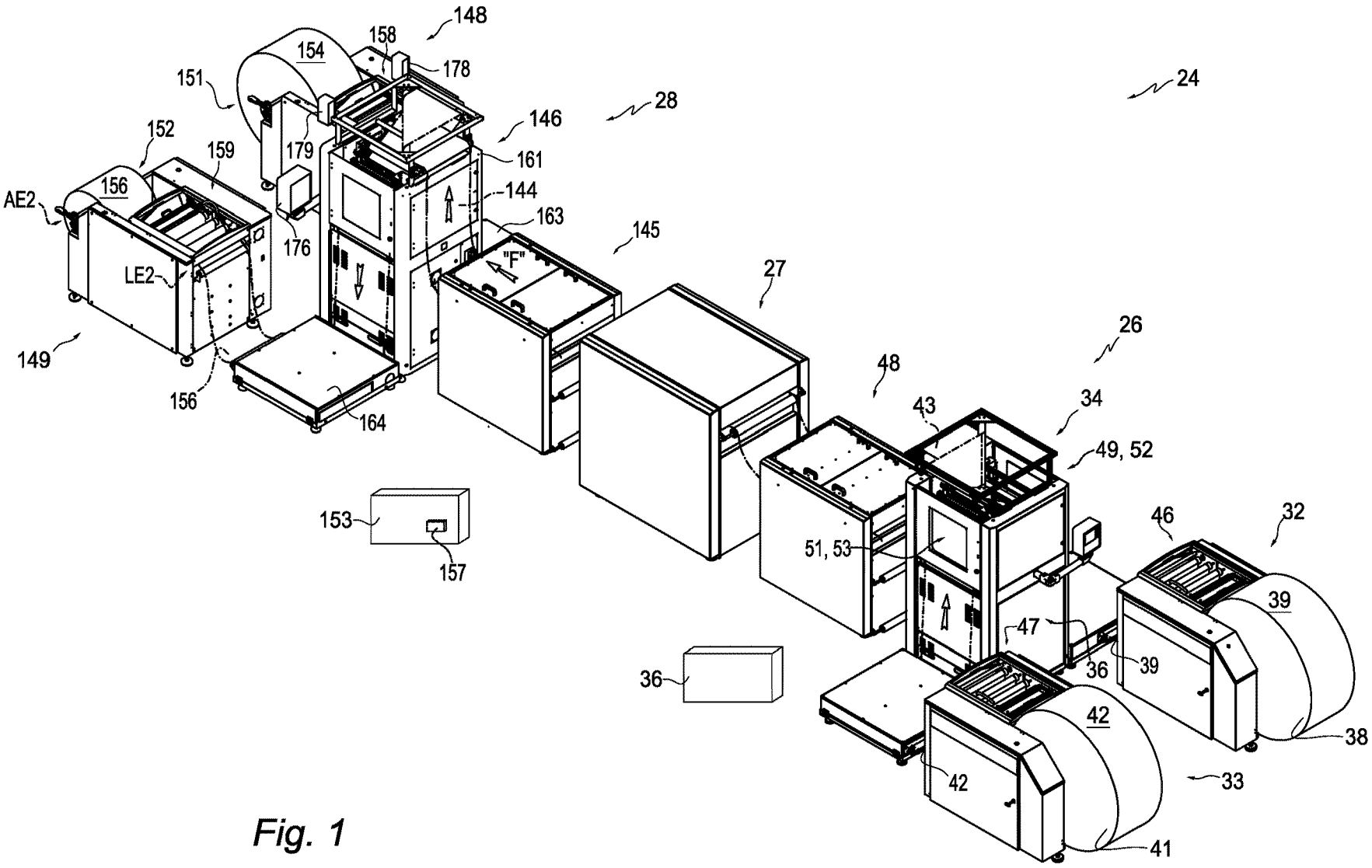
FIG. 1 is a schematic view of a high-speed digital printing system for a continuous paper web, in accordance with the invention.

FIG. 1 shows a high-speed digital printing system, represented with 24, for a continuous paper web which comprises, arranged in series, a web unwinding and splicing installation 26, a printing station 27 and a splicing and rewinding installation 28.

Unwinding and Splicing Installation

The unwinding and splicing installation 26 (FIGS. 1 and 2) includes two input unwinding machines 32 and 33 with respective buffer groups 46 and 47 for two input web coils 38 and 41, an input cutting and splicing equipment 34, a feed buffer group 48 and an electronic control unit or controller 36.

The input cutting and splicing equipment 34 supplies, in turn and automatically through the feed buffer group 46, the printing station 27 with a paper web 39 or 42 of the two input coils 38 and 41 for printing on an output web 43 in continuous movement. This is to ensure easy replacement of an empty coil with a full coil or in order to produce prints on webs of different typology.

The unwinding and splicing installation 26 and the printing station 27 were included as splicing equipment 34 and printer 48 of the system 31 for treating webs described in the above mentioned Italian Patent No. 1,428,679. This patent is herein incorporated for appropriate references, with the notation that the same numbering has been maintained for the parts with similar functionality.

Figure 3:
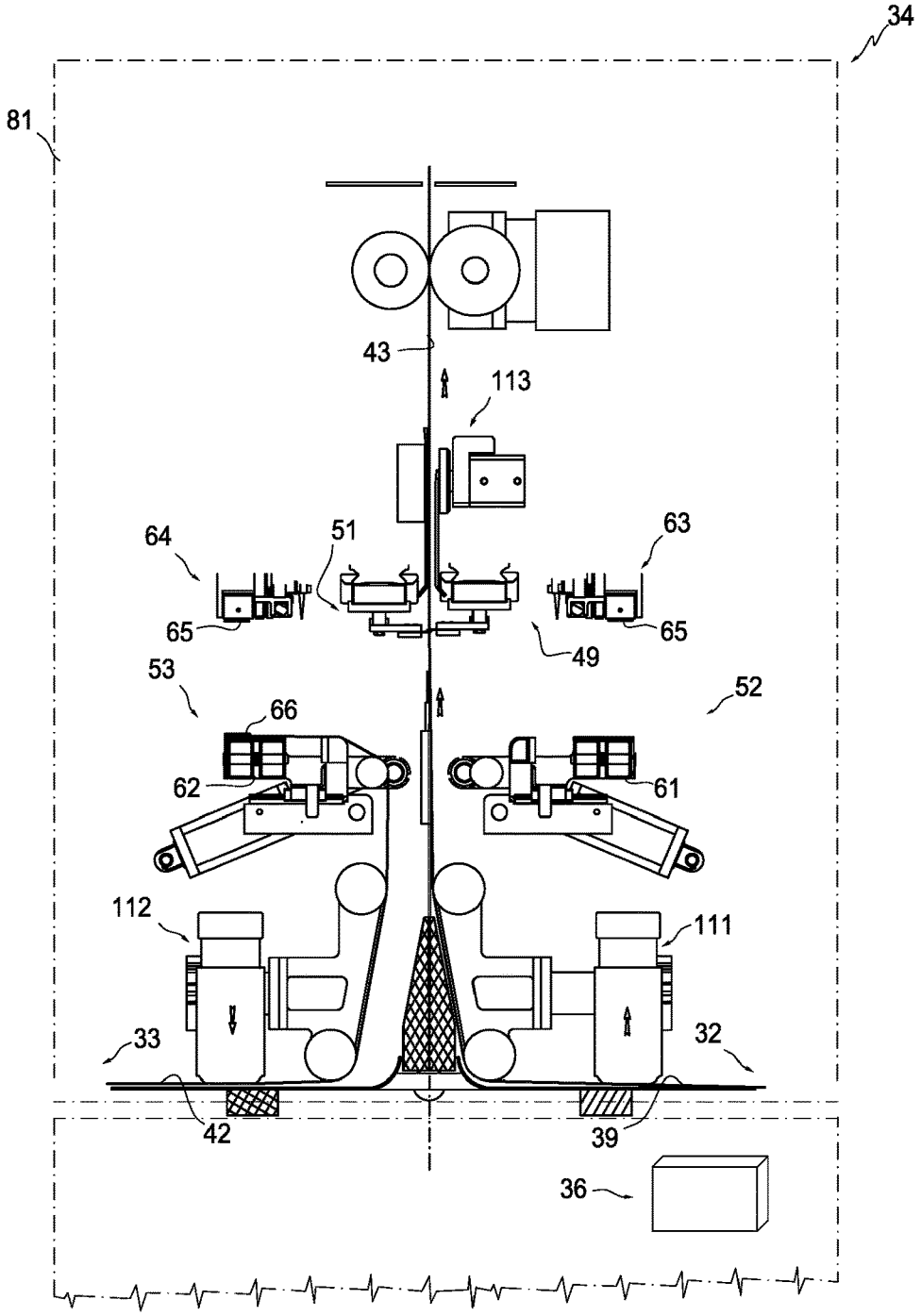
FIG. 3 shows a schematic drawing of an equipment of FIG. 1

In extreme synthesis, in the unwinding and splicing installation 26 of the present application, the input cutting and splicing equipment 34 comprises a tower container structure 81 (FIG. 3). A lower body of the structure 81 houses the control unit 36 and components of service, while an upper body houses two cutting mechanisms 49 and 51, splicing groups 52 and 53 with retaining members 61 and 62 and adhesive applying devices 63 and 64.

The cutting and splicing equipment 34 also comprises two input stopping mechanisms 111 and 112 for arresting the first web 39 and the second web 42 and an output stopping mechanism 113 for arresting, respectively, the output web 43 in phases of cutting and splicing. The input stopping mechanisms 111 and 112 each comprise a pair of pneumatically actuatable pads which operate on the webs 39 and 42, while the output stopping mechanism 113 comprises another pneumatically actuatable pad, which operates on the output web 43.

The electronic control unit 36 activates the stopping mechanism 111 or 112 and 113 the cutting mechanism 49 or 51 and the splicing group 52 or 53 so as to form the output web 43 with the web 39 coming from the input web coil 38 or with the web 42 coming from the input web coil 41. The splicings relate to webs of a same typology in the event in which the splicing is consequent to emptying of a coil and its replacement with a full coil.

Figure 3A:
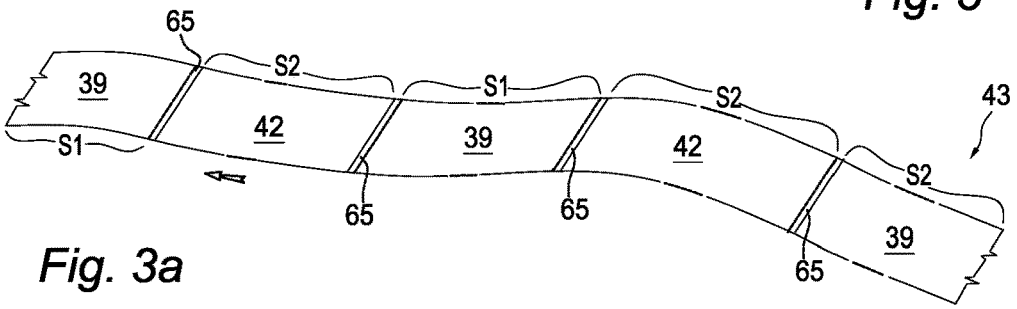
FIG. 3*a* is a schematic view of a continuous web of the system of FIG. 1.

More generally, the unwinding and splicing installation 26 can form the output web 43 (see FIG. 3*a*) with sections S1 of the web 39 coming from the input web coil 38 of a given typology, alternated by splicing, with sections S2 the web 42 coming from the coil 39 of a different typology without stopping the printing station 27. The operations of cutting and junctions of the system 26 are controlled by the control unit 36 on the basis of a program in remote and/or by manual controls by means of a terminal 59.

The retention member 61, 62 retains, after cutting, an initial edge of the web coming from the coil 38 or an initial edge of the web coming from the coil 42 in preparation for a splicing on a terminal edge of the output web, while the adhesive applying devices 63 and 64 apply a biadhesive film 65 on the initial edges of the waiting coils.

For the complete operation of the unwinding and splicing installation 26, reference should be made to what is described in connection with the splicing equipment 34 of the aforementioned Patent No. 1,428,679.

As an exemplary recall, with the output web 43 formed by the web 39 (FIGS. 2 and 3), the unwinding machine 32 unwinds the web 39 while the unwinding machine 33 is at rest and the web 42 is ready for a splicing with the output web 43. At a request of the printing station 27 for the web 42 on control of the control unit 36, the pneumatic pads of the input stopping mechanisms 111 and 112 are actuated and the unwinding machine 32 is arrested with locking of the webs 39 and 43. The web 39 is cut, its initial edge is moved away, while the initial edge of the web 42 is joined with the terminal edge of the output web 43. After the release of the pneumatic pads of the input stopping mechanisms 111 and 112, the unwinding machine 33 is restarted to the subsequent feeding of the printing station 27 with the output web 43 formed with the web 42.

Splicing and Rewinding Installation

According to the invention, in the digital printing system 24, the splicing and rewinding installation 28 (FIGS. 1 and 2) operates on the output web 43 exiting from the printing station 27, hereinafter referred to as incoming web 144, and comprises a rewinding buffer group 145, an output cutting and splicing equipment 146, two rewinding machines 148 and 149 with two respective output coils 151 and 152 and an electronic control unit or controller 153. In particular, the buffer group 145, and the equipment 146 are aligned with the printing station 27 along a feeding direction F of the web 43. The control unit 153, through the rewinding buffer group 145, activates the output cutting and splicing equipment 146 for feeding the rewinding machines 148 and 149 in turn with the incoming web 144. The web 144 is cut, sliced with a web of the output coils 151 or 152, conventionally indicated as the first web 154 and as the second web 156 and rewound by the machines 148 or 149.

For an effective response to the various requirements of the printing system 24, the splicing and rewinding installation 28 performs the cutting, splicing and rewinding operations automatically and without stopping the printing station 27. This is achieved by the electronic control unit 153 on the basis of a program 157, of information coming from the web 144 and/or from executed prints and from the functional components of the installation 28, in particular from information of the rewinding machines 148 and 149 and of manual or remote commands.

Specifically, the electronic control unit 153 responds to an operational change of the system from a reference condition to a modified condition for switching the functionality of the output cutting and splicing equipment 146 and the rewinding machines 148 and 149 from a reference configuration to a switched configuration of the printing system 24. To this end, the control unit 153 operates on rewinding machines 148 and 149 by setting the output coils 151 and 152 as an operating coil and as a waiting coil and reports the functionality of the output cutting and splicing equipment 146 and the rewinding machines 148 and 149 to the reference configuration, by resetting the output coils 151 and 152 as a waiting coil and as an operating coil.

In accordance with a feature of the invention, the splicing and rewinding installation 28 can rewind, in a differentiated way, the incoming web 144 with the sections S1 and S2 of different typologies, already of the output web 43 (see FIG. 3*a*), into the output coils 151 and 152. Corresponding information is associated with the typologies of the sections S1 and S2. The electronic control unit 153 responds to the information typology of the sections S1, considered as reference typology, for setting the output cutting and splicing equipment 146 and the rewinding machines 148 and 149 so as to rewind the incoming web 144 in a first output operating coil 151, 152 and maintaining waiting a second output coil 152, 151.

Upon detection of the typology information of the sections S2, the electronic control unit 153 sets the output cutting and splicing equipment 146 and the rewinding machines 149, 148 so as to rewind the incoming web 144 with the sections S2 of a different typology in the second output coil 152, 151 as an operating coil, maintaining waiting the first output coil 151, 152 on which had been wound the sections S1 with the reference typology.

Upon a new detection of information on the sections with the reference typology of the section S1, the control unit 153 rewinds the outgoing web with the section of reference typology on the first coil 151, 152, by resetting the rewinding machine 148, 149 with the first coil 151, 152 as operating coil and the rewinding machine 149, 148 with the second coil 152, 151 as waiting coil.

In detail, in the splicing and rewinding installation 28 of the system 24, the rewinding machines 148 and 149 are commercial, integrate respective buffer groups 158 and 159 and support the cores of the coils 151, 152 with the possibility of easy replacement.

Figure 4:
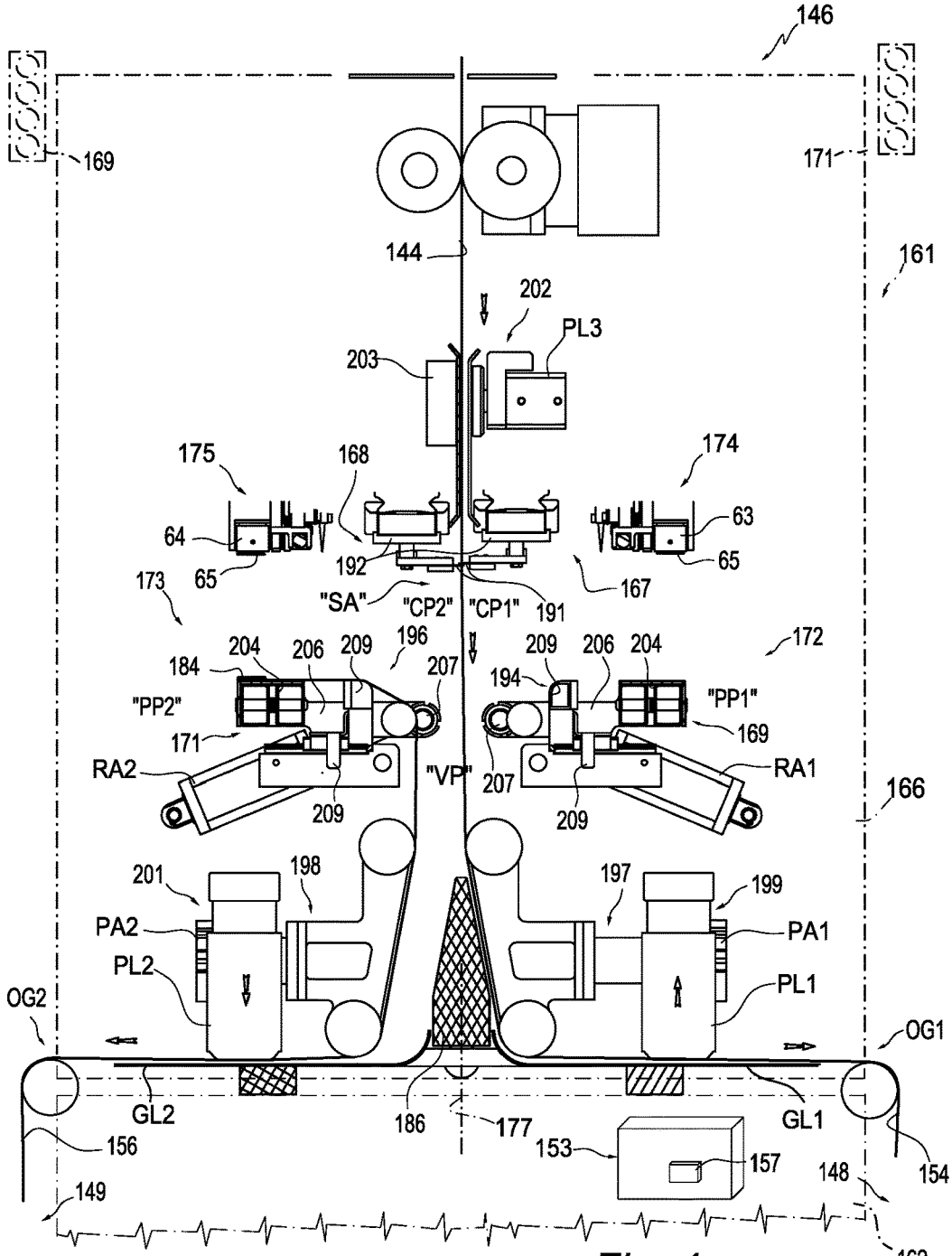
FIG. 4 represents a schematic drawing of another equipment of FIG. 1 according to the invention in a first operating configuration and FIG. 4*a* is a view of a web of FIG. 4.

The output cutting and splicing equipment 146 (FIGS. 1, 2, and 4) comprises a tower containing structure 161. A lower body 162 of the structure 161 houses the control unit 153 and service components and is associated on a lower part to a first platform 163 and a second platform 164, while an upper body 166 of the containing structure 161 (FIG. 3) houses a first cutting mechanism 167, a second cutting mechanism 168, splicing groups 172 and 173 with retaining members, 169 and 171 and adhesive applying devices 174 and 175.

On the turret structure 161 are also mounted a terminal 176 and two traffic lights 178 and 179. The terminal 176 is designed for performing manual settings of splice parameters and to initialize the splicing and rewinding installation 28. The traffic lights 178 and 179 are mounted on an upper part and at sides of the tower structure 161 and have four lights L1 green, L2 white, L3 yellow and L4 red, which provide information on the status of the rewinding machine 148 and 149 and of the functional components of the cutting and splicing equipment 146.

The arrangement of the mechanisms 167 and 168, the splicing groups 172 and 173 and the traffic lights 178 and 179 is symmetrical with respect to a vertical geometrical plane 177, conventionally to the right and left with respect to the direction F of advancement of the output web 43. The platforms 163 and 164 and the rewinding machines 148, 149 are aligned and are also arranged symmetrically to the right and left on opposite sides with respect to the plane 177. The traffic light 178 gives indications on the rewinding machine 148, on the cutting mechanism 167 and on the splicing group 172 of the right part of the installation 28, while the traffic light 179 gives indications on the rewinding machine 149, on the cutting mechanism 168 and on the splicing group 173 of the left part of the installation.

The web 144 emerging from the printing station 27 enters from the top of the upper body 166 of the structure 161 with downward movement, in a condition of tangency with the plane 177 and defined at the output as the first web 154 or as the second web 156 to be rewound through ports GL1 and GL2 and guide sheets GL1 and GL2 at the base of the upper body 166.

The webs 154 and 156 are deviated along two vertical walls of the lower body 162 parallel to the plane 177, are guided below of the platforms 163 and 164 and exit horizontally from the platforms 163 and 164 parallel to the direction F toward the rewinding machines 148, 149.

The rewinding machines 148, 149 are arranged side by side adjacent to a respective edge of the platforms 163 and 164 adjacent to the edge of emersion of the webs 154 and 156. Conveniently, two roller deviation devices are arranged below the platforms 163 and 164 to provide a 90° deviation of the path of the webs 154 and 156. The platforms 163 and 164 have an upper floor that can be walked on, accessible by the operators and opened to access the path of the webs 154 and 156.

Figure 5A:
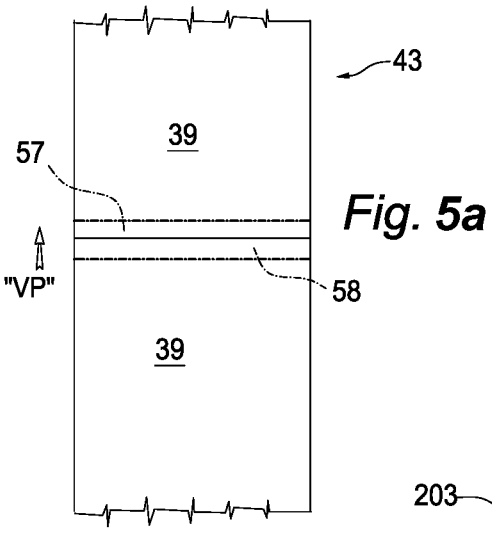
FIG. 5 shows a schematic view of the equipment of FIG. 4 in a second configuration and FIG. 5*a* is a view of webs of FIG. 5.
Figure 9:
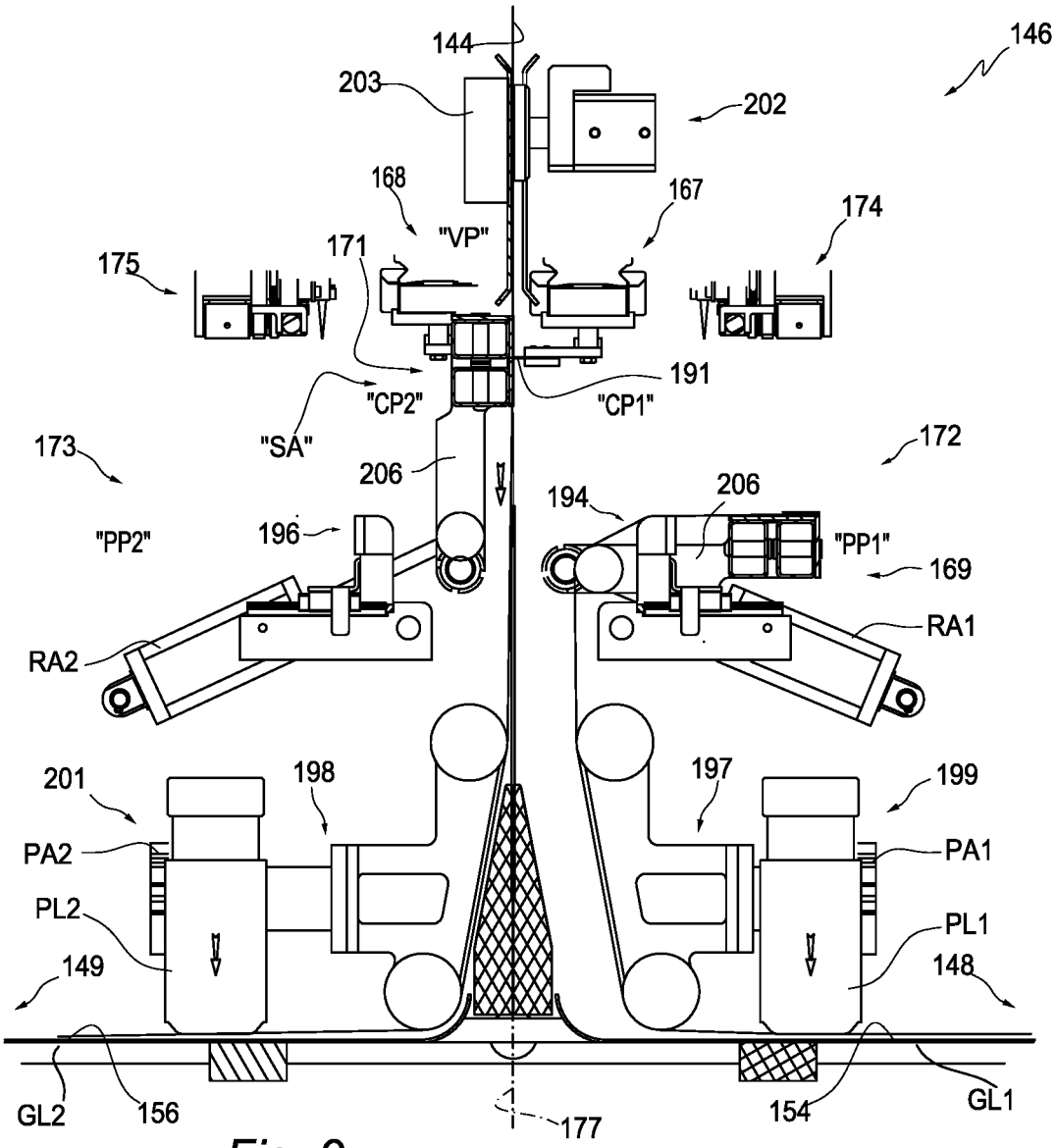
FIG. 9 shows a schematic view of the equipment of FIG. 4 in a sixth operating configuration and FIG. 9*a* is a view of a web of FIG. 7.
Figure 9A:
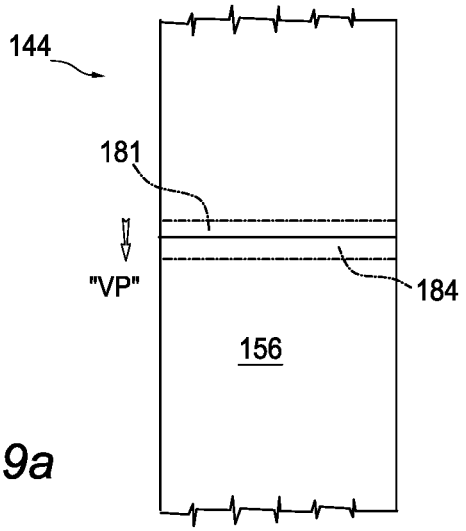

In the equipment 146 (FIG. 5), the second cutting mechanism 168 can be activate to cut the incoming web 144 and the rewinding web 154, defining a terminal edge 181 (see FIG. 5*a*) of the web 144 and an initial edge 182 of the first web 154 connected to the coil 151. Similarly the cutting mechanism 167 is operable to cut the incoming web 144, defining, jointly to the terminal edge 181 (see FIG. 9*a*), an initial edge 184 of the second web 156 connected to the coil 152.

Figure 10A:
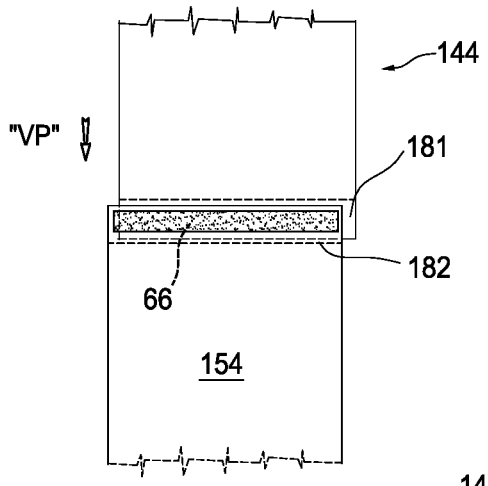
FIG. 10 is a schematic view of the equipment of FIG. 4 in a sixth operating configuration and FIG. 10*a* is a view of webs of FIG. 10.
Figure 10:
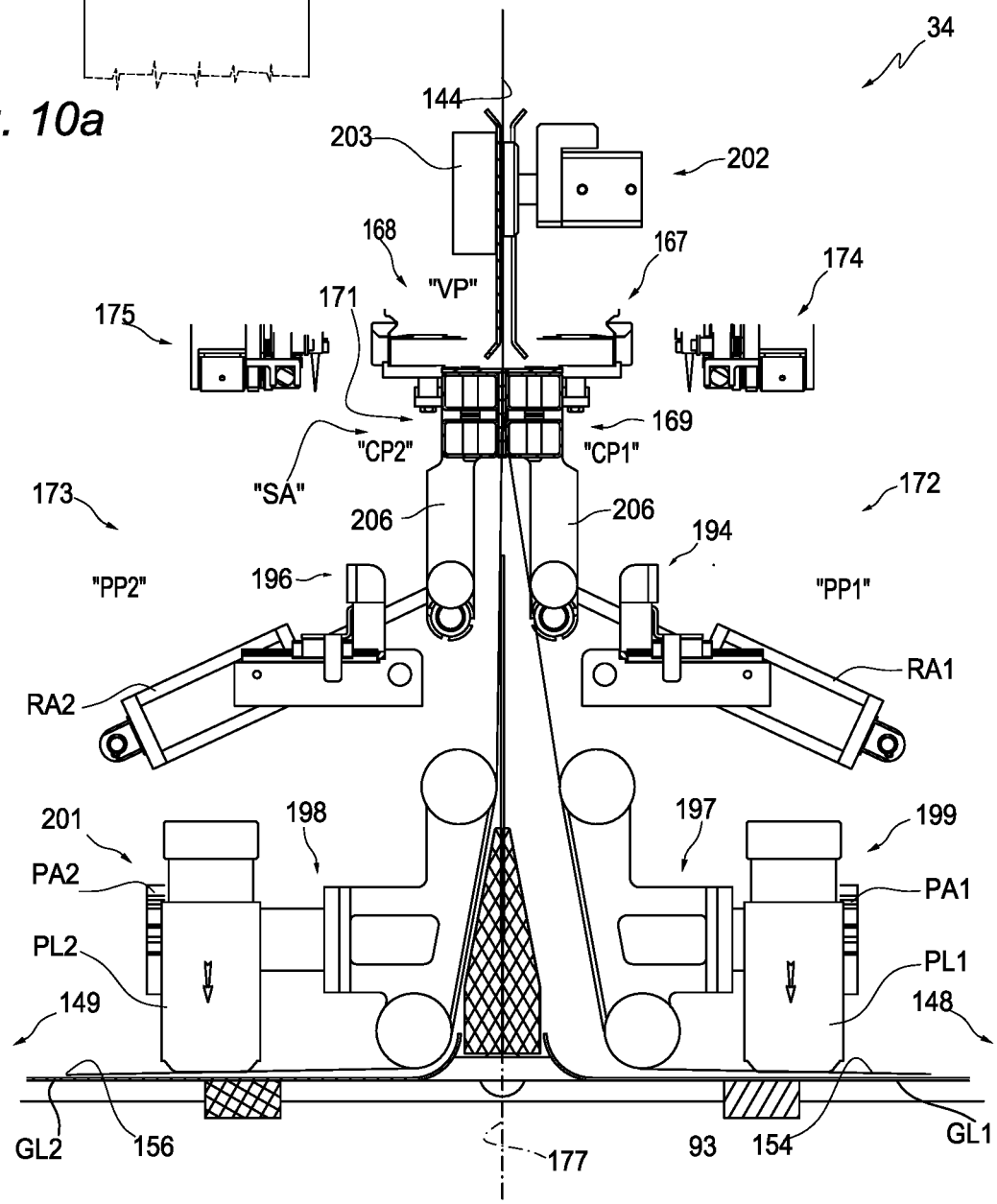

The first splicing group 172 (FIGS. 4 and 5) can be activated for splicing on the terminal edge 181 (see FIG. 10*a*) the initial edge 182 of the first web 154. The second splicing group 173 can instead be activated for splicing on the terminal edge 181 (see FIG. 6*a*) the initial edge 184 of the second web 156.

In accordance with the invention, the control unit 153 (FIGS. 4-10) is provided for activating the first cutting mechanism 167 or the second cutting mechanism 168 and the first splicing group 172 or the second splicing group 173 in such a way as to connect the incoming web 144 with sections of the first web 154 in winding on the coil 151, alternating with sections of the second web 156 in winding on the coil 152.

Figure 5:
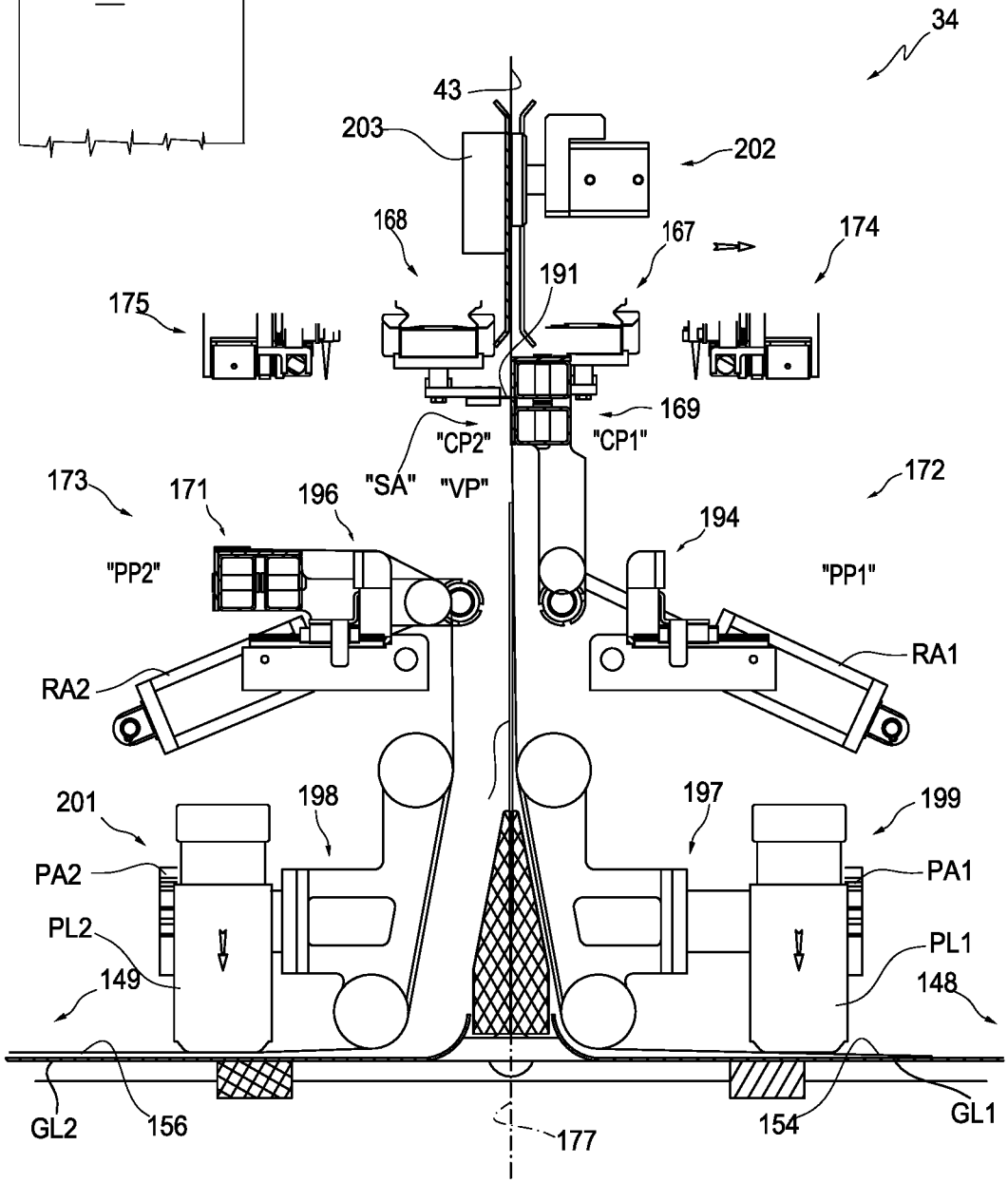
Figure 6:
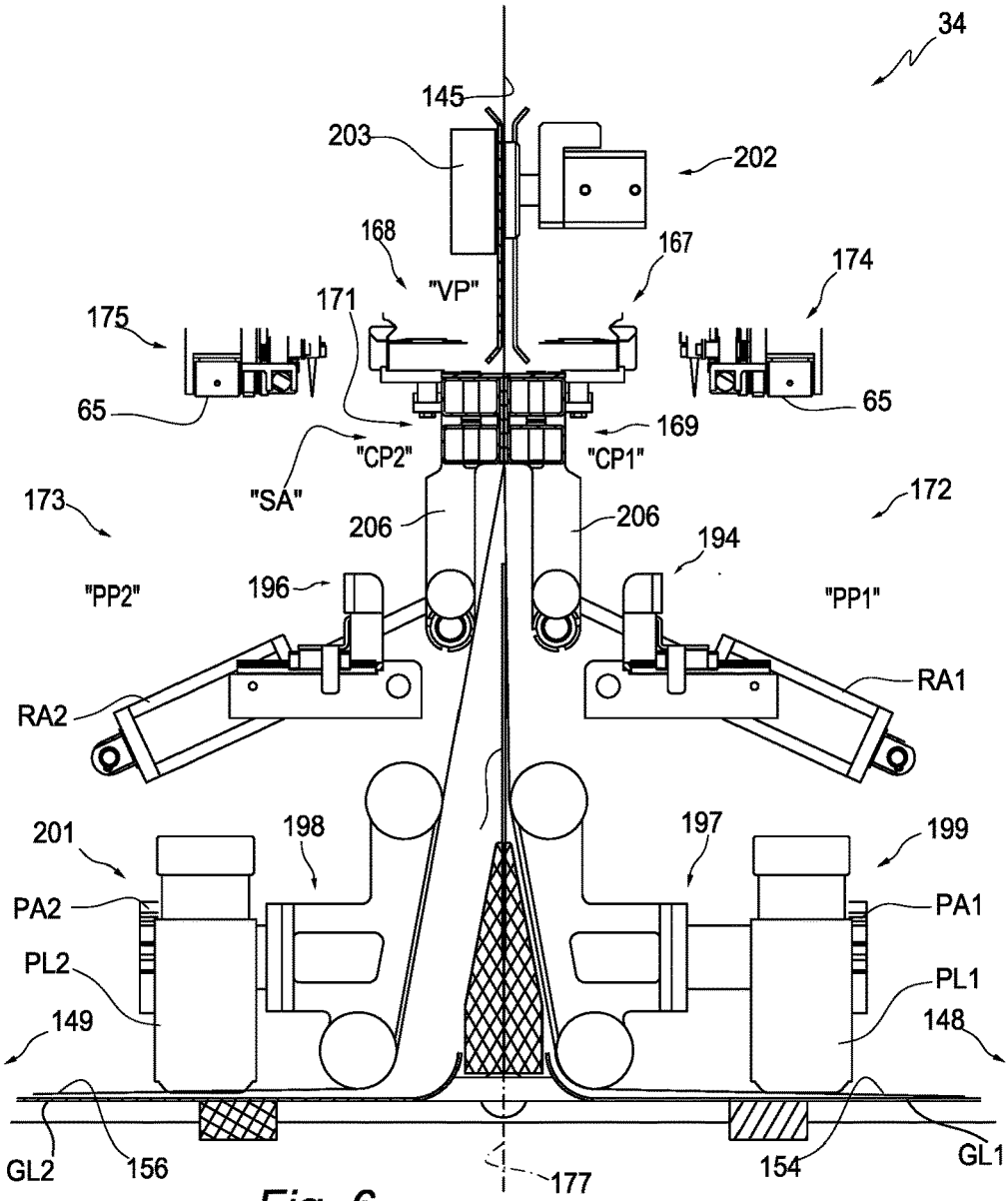
FIG. 6 represents a schematic view of the equipment of FIG. 4 in a third operating configuration and FIG. 6*a* is a view of webs of FIG. 6.
Figure 6A:
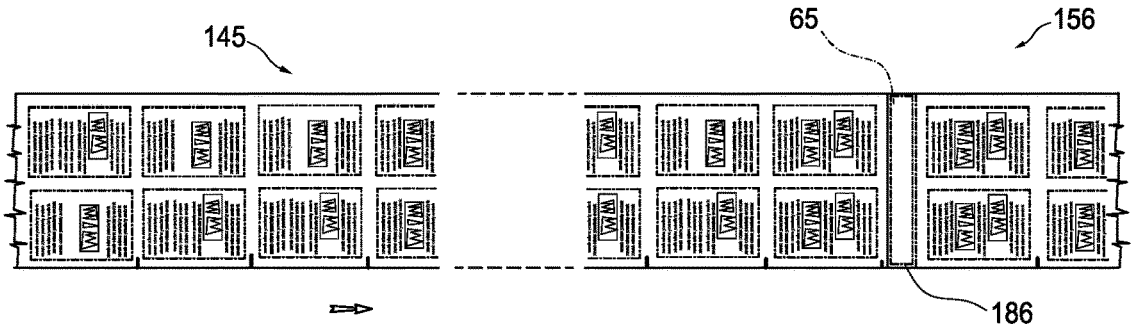

The retaining members 169 and 171 are designed to retain the initial edge 182 of the web 154, inactive (see FIG. 8), and the initial edge 184 of the web 156, also inactive (see FIG. 5). The retaining members 169 and 171 are also provided for moving the retained edges of the webs in a position of predisposition for the deposition of the adhesive film. This prepares a junction on the incoming web 144 to the initial edge of the first web 154 or to the initial edge of the second web 156.

The deposition of the adhesive is automatic upon activation of the electronic unit 153. The adhesive applying devices 174 and 175 can be constituted by the adhesive applying devices 63, 64 for the biadhesive film 65 described in the Italian Patent No. 1,428,679, the description of which is omitted herein for brevity, or by adhesive injection applicators. As far as the present invention it concerns, the applying device 174, 175 can be activated by the control unit 153 for applying the biadhesive film 65 or a layer of glue on the initial edge 182, 184 of the web 154, 156 retained by the retaining member 169, 171.

Upstream of the gates OG1 and OG2, the webs 154 and 156 are guided by a switching wedge 186 in axis with the plane 177 to define a common vertical path VP of the webs 154 and 156 with a movement directed downwards, tangent to the plane 177.

In the path VP is shows a junction area SA, above the switching wedge 186, in which the operations of cutting and splicing of the incoming web 144 with the web 154 or the web 156 are carried out. The web 154 and the web 156, when they are spliced to the incoming web 144 and in rewinding by the rewinding machines, provide for the feed of the web 144 along the VP path toward the junction area SA.

The first cutting mechanism 167 and the second cutting mechanism 168 each include a cutting element 191 which can be actuated to perform a transverse cut on the incoming web 144 in the area of junction SA. In particular, each cutting element 191 is constituted by a blade with a double inclination cutting edge mounted on a carriage 192, which is arranged to slide on a horizontal rail located transversely to the path VP of the web 144. A double acting pneumatic cylinder (not shown) is actuatable, on command of the control unit 153, for moving the carriage 192 from one side to the other of the web 144 along the rail between two rest positions external to the path VP, so as to perform cross cuts of the web 144 from right to left and, vice versa, from the left to the right.

The retaining member 169, 171 is susceptible of positioning between a contrast position CP1, CP2, substantially vertical, adjacent to the reference plane 177 of the junction area SA and a predisposition position PP1, PP2 for preparing the junction, substantially horizontal, away from the reference plane 177. The retaining members 169 and 171 are controlled by two respective pairs of actuators RA1 and RA2 of a pneumatic type.

In the contrast position CP1, CP2, the retaining member 169, 171 acts as a support for the web 156, 154 in the action of the cutting element 191 for cutting the incoming web 144.

After the cutting of the web and in the contrast position CP1, CP2, the retaining member 169, 171 has a function of contrast for the other retaining member 171.169 for a pressure joining on the terminal edge 181 of the initial edge 184 of the web 156 and, respectively, of the initial edge 182 of the web 154.

In the junction preparation position PP1, PP2, the retaining member 169, 171 has the function of retaining for the inactive respective initial edge 182, 184 of the web 154, 156 and a function of contrast for the application of the adhesive on the initial edge 182, 184.

The junction of the webs takes place with overlap for a certain amount of the initial edges 182 and 184 of the webs 154 and 156 with respect to the terminal edge 181 of the incoming web 144. To this end, the first splicing group 172 and the second splicing group 173 comprise a respective edge shifting member 194 and 196 for moving the inactive initial edge 182 or 184 of the web retained by the retaining member 169 or 171 by an amount corresponding to an overlap distance.

In turn, a first recovery member 197 and a second recovery member 198 are provided for recovering a section of the web 154, 156 corresponding to the overlap distance. The recovery member 197 is operative between the first web 154 and the first splicing group 172, while the recovery element 198 is operative between the second web 156 and the second splicing group 173.

Conveniently, the cutting and splicing equipment 146 comprises two output stopping mechanisms 199 and 201 for stopping the first web 154 and, respectively, the second web 156 and a stop mechanism input 202 for stopping the incoming web 144 in cutting and splicing phases. The stopping mechanisms 199 and 201 each comprise a pair of pneumatically operated pads PL1 and PL2 that operate on the webs 154 and 156 against the sheets of guides GL1 and GL2 near the gates OG1 eOG2. The stopping mechanism 202 comprises another pneumatically operated pad PL3 that operates on the incoming web 144 against a contrast bar 203.

The buffer groups 158 and 159 (FIGS. 1 and 2) limit the accelerations of the webs 154 and 156 in rewinding on the respective coils 151 and 152 in a phase of temporary stopping by the mechanisms 199 and 201 during the phases of cutting and splicing and the final stopping of the waiting web. The rewinding buffer group 145 in turn ensures the continuous operation of the printing station 27. The printed and not rewound sections of the web are accumulated by the rewinding buffer group 145 during the temporary stops of the incoming web 144 and are released when the splicing and rewinding installation 28 is started up again.

The retaining members 169 and 171 (FIG. 4), the edge shifting members 196 and 197 and the recovery members 197 and 198 of the splicing and rewinding installation 28 are similar to the members 61 and 62, the edge shifting members 106, 107 and the recovery members 108 and 109 of the unwinding and splicing installation 26 of the Italian Patent No. 1,428,679 and, for brevity, the detailed description should be referred to that document.

In summary, the retention of the initial edges of the webs 154 and 156 by the retaining members 169 and 171 and of the recovery members 196 and 197 is obtained by suction holes in airtight chambers of these members connected to a vacuum generator of the output cutting and splicing equipment 146 and solenoid valves controlled by the electronic control unit 153.

Each retaining member 169, 171 comprises a hollow section member 204 as an airtight chamber in which suction holes are formed. The hollow section member 204 is fixed transversely to two arms 206 pivoted about respective axes 207 adjacent and on opposite sides with respect to the plane 177 and controlled for rotation by two pairs of pneumatic actuators RA1 and RA2 also controlled by the electronic unit 153.

The edge shifting member 194, 196 is formed by a hollow section member 208 as another airtight chamber, in which suction holes are formed for the edge 184, 186 of the web 154, 156. The member 208 is mounted on a frame 209 in turn slidable on two horizontal rails located on opposite sides of path VP, perpendicularly to the vertical plane 177. Thus, with respect to retaining member 169, 171 in the predisposition position PP1, PP2, the edge shifting member 194, 196 is moveable from a rest position in which the hollow section member 208 is distant from the hollow section member 204 to an operative position in which the hollow section member 208 is close to the member 204. The stroke of the frame 209 between the rest position and the operative position of the shifting member 194, 196 corresponds to the overlap distance between the edges to be spliced of the webs 154 and 156.

The recovery members 197 and 198 can be moved by pneumatic actuators PA1 and PA2 between a rest position and a recovery position respectively associated to the rest position and the operative position of the edge shifting member 194, 196.

The width of the incoming web 144 may be different from that of the waiting web 154 or 156. For an optimized junction, the electronic unit 153 controls the deposition stroke of the adhesive on the web 154 or 156 in response to the information on the webs in such a way that the adhesive is limitedly to the width of the narrowest web.

The output cutting and splicing equipment 146 also provides alignment mechanisms of the webs 154 and 156 in rewinding. For this purpose, the diverting devices 180 (FIG. 2) below of the platforms 163 and 164 are moved by respective servomechanisms 211 and 212 and on control of the electronic unit 153 in such a way as to align a side of the webs 154 and 156 with respect to a common plane of the rewinding machines 148 and 149.

With the switching of the output cutting and splicing equipment 146 and the rewinding machines 148 and 149, the digital printing system 24 of the invention ensures the execution of prints without interruptions on the continuous web and rewinding on the coil, complying with the following requirements:

- formation of output coils with homogenous typologies;
- replacement of the output coils in conditions of full;
- management of programmed calibration and purging in ink jet printers;
- management of junctions in working orders;
- management of urgencies;
- handling of empty or defective sections of web emerging from the printing station; and
- handling of jamming without effect on rewinding in progress.

Figure 4A:
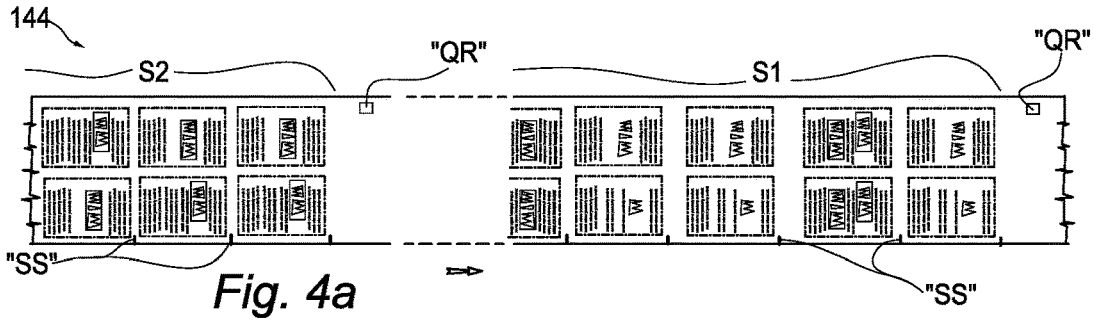

With regard to the information used by the electronic control unit 153 for the automatic operations, those pertaining to modified conditions of the incoming web 144 can be derived from suitable prints of the web. In particular, the delimitation of the printed pages can be entrusted to synchronization notches SS (see FIGS. 4*a* and 6*a*) printed by the printing station 27 on margins of the same pages, while a predetermined number of such notches can define the presence of sectors devoid of printing, sectors of calibration and purge, and sectors of separation between successive work orders along the web 144.

The data for the switching relating to the formation of the coils 151, 152 with homogenous typologies and the management of urgencies, can be provided by identification (bar) codes QR associated to the work orders and also printed by the printing station 27.

The synchronization notches SS and the identification codes QR can be read by sensors (not shown) of the splicing and rewinding installation 28, upstream of the output cutting and splicing equipment 146. Failure to read the notches and/or the identification codes can be recognized as indicative of the presence of an empty sector or with printing defects of the web 144 requiring the switching for the rewinding on a different coil.

The indications on changes in typology and/or on printing defects can be derived from a scanning device (not shown) of the splicing and rewinding installation 28, upstream of the output cutting and splicing equipment 146 and from a typology/print errors recognition software of the program 157. The change of typology is signaled by a lack of congruence between the material to be printed and the effectively printed material on the incoming web 144.

As far as the modified conditions of the digital printing system 24 are concerned, the associated information can be obtained from sensors arranged along the path of the webs 144, 154 and 156 on the output cutting and splicing equipment 146 and on the output rewinding buffer group 145. The sensors, of a known type and not shown in the drawings, provide in particular the information required for handling jamming of the webs.

For the information coming from the rewinding machines 148 and 149, the filling condition of the output coils 151 and 152 can be obtained from respective linear position transducers 213 and 214 and angular position transducers 216 and 217. The linear transducer 213 and 214 are mounted downstream of the buffer groups 158 and 159 and detect increments of movement of the web 154, 156 in winding while the angular transducers 216 and 217 detect increments of rotation of the rotating axes supporting the coils 151 and 152. The filling degree of the output coils 151 and 152 is then calculated by the control unit 153 or by electronic controllers of the machines 148 and 149 according to a known technique. Such electronic controllers can operate using electronic hardware, including, but not limited to microprocessors, state machines, FPGAs, ASICs and/or a combination thereof, and can utilize various firmware and/or software (consisting of non-transitory, computer-readable program instructions).

The information for the automatic operations are appropriately integrated with operating and junction parameters, which can be set from the terminal 176 or from remote. In addition, the electronic control unit 153 of the splicing and rewinding installation 28 exchanges data with the control unit 36 of the unwinding system 26 and with the printing station 27 for the synchronization of the various components and for optimized management of the junctions.

Figure 11:
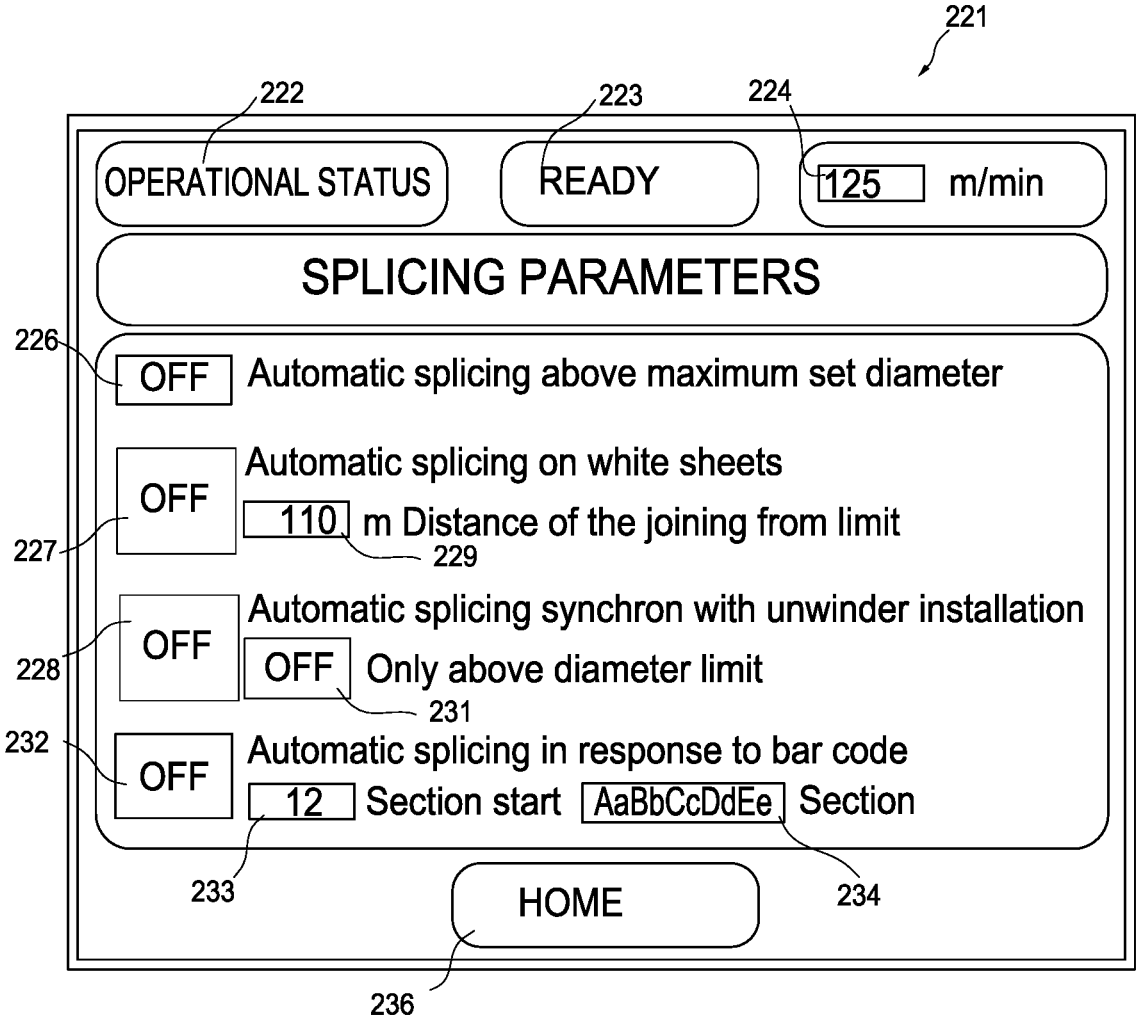
FIG. 11 is a detail of a component of the printing system of FIG. 2.

Specifically, with reference to FIG. 11, in the terminal 176, a touch screen, designated by the reference numeral 221 has a status indicator 222, a ready light 223 and a speed indicator 224. The status indicator 222 indicates a state of stopping or a state of positioning, for example for calculating the diameter of the coils, for emptying of the buffers or for the state of operation of the splicing and rewinding installation 28. The ready light 223 is indicative of a ready state for the operation, while the speed indicator 224 represents the speed of advance of the output webs 43 and 144.

With regard to the parameters of junction, the screen 221 has an area 226 and two areas 227 and 228 with specific areas 229 and 231 and an area 232 with specification areas 233 and 234. These areas can be activated to fix the criteria concerning the splices of the webs 144, 154 and 156. The areas 226, 227 and 228 relate to junctions 228 dependent on the achievement of the condition of full coil conditioned by the areas 229 and 231, while the area 232 relates to the splicing controlled by other requirements.

In synthesis, the area 226 can be activated to carry out or not the switching from the operative state to the waiting state of the rewinding machine 148 or 149 and the automatic splicing when it has reached the maximum diameter of setting of the respective coil 151 or 152. The area 227 can be activated to execute or not the switching from the operative state to the waiting state of the rewinding machine 148 or 149 and the automatic splicing when it has been detected the presence of blank sheets (for example for the failure to read synchronization notches) at a splice distance from the limit defined in the settable area 229. This, for example, to prevent a junction in an area intended for the printing of a page or to prevent that a work order is divided by prints of two different coils.

The area 229 is operable for executing the splicings by the splicing and rewinding installation 28 in synchronism with the splicings of the unwinding and splicing installation 26 with or without the condition of the area 231 and for executing the splicings only above the maximum diameter limit at a distance from the junction of output web 43 defined in the area 222.

The area 232 is operable for executing or not the switching of the operating status and the automatic splicing in response to reading of the identification code, at a distance defined in the area 233 and with a content defined in the area 234. An area 236 is indicative of a return of the installation 28 to an initial state.

The switching of the output cutting and splicing equipment 146 and of the rewinding machines 148 and 149 from the reference configuration to the switched configuration can be started even remotely, through the printing station 27, for example in the event of extra line urgent works or for works of a nature different from the ones of the programmed works. The splicing and rewinding installation 28 returns to the reference configuration when the printing of the work has been completed.

Operation

Figure 2:
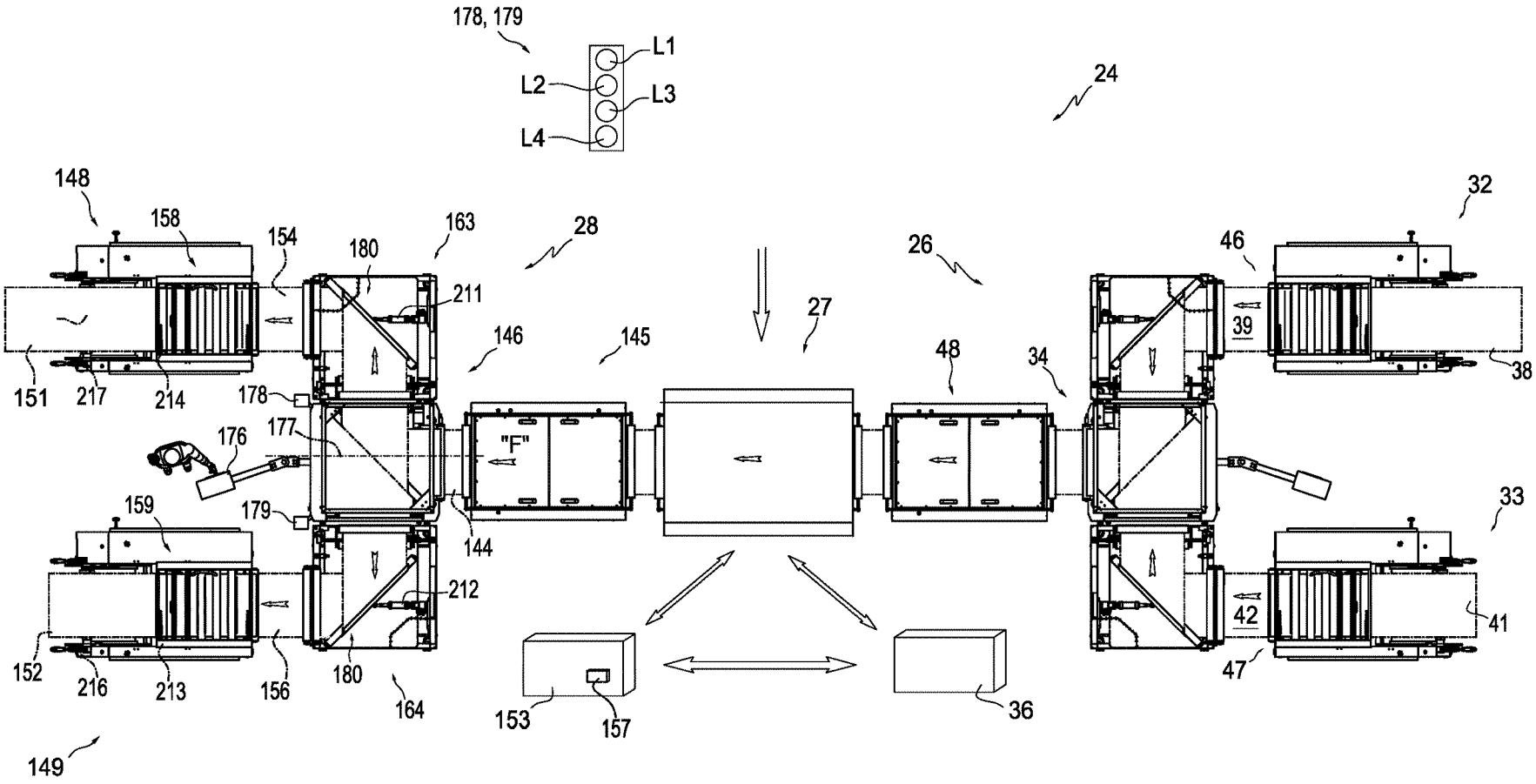
FIG. 2 is a schematic plan view of the printing system of FIG. 1.

With reference to FIGS. 1 and 2, the splicing and rewinding installation 28 of the printing system 24 is shown fully operational for the rewinding of webs 154 and 156 of a different typology, partially wound on the output coil 151 and on the output coil 152.

In a reference configuration, a conventionally right part of the splicing and rewinding installation 28 is operating and the left part is waiting. The incoming web 144 (see FIG. 4*a*) is formed by the sections S1 with the reference typology while the first web 154, in rewinding on output coil 151, comprises work orders consistent with the reference typology. The first rewinding machine 148 is operative and rewinds the web 154, while the second rewinding machine 149 is stopped and the web 156 on the output coil 152 is ready for a junction to the incoming web 144.

It should be clear to those of skill that, alternatively and with appropriate changes, the reference configuration can be that in which the left part of the splicing and rewinding installation 28 is operating and the right part is waiting.

The reference configuration is reached after an initialization phase and the system 24 at rest. In this reference configuration, the cores of the output coils 151 and 152 with end web segments have been mounted on the rewinding machines 148 and 149; further, an initial edge 184 of the web 156 has been fixed to the splicing 173 and the edge 182 of the web 154 was joined on the edge 181 of the incoming web 144.

In the splicing groups 172 and 173 (FIG. 4), the retaining members 169 and 171 are in the respective predisposition positions PP1 and PP2 and the input stopping mechanism 201 blocks the web 156. The retaining member 169 is inactive and free, while the retaining member 171 retains, by action of the vacuum, the initial edge 184 of the second web 156 on which the adhesive has already been deposited and is prepared for the junction. In the splicing group 172, the edge shifting member 194 and the recovery member 197 are in the respective rest and recovery positions, and in the splicing group 173, the edge shifting member 196 is in the rest position while the recovery member 198 is in its operative position.

Upon reception of a work order with prints on the web 144 (FIG. 5*a*) concerning the sections S2, of different technology, to be connected on the web 156, the control unit 153 stops the rewinding machine 148 and activates the pneumatic pads PL1 and PL3, with blocking of the webs 154 and 144 (FIG. 5) in a predetermined and controlled with respect to the area of junction SA. The control unit 153 then activates the pair of pneumatic actuators RA1 and the pneumatic cylinder of the cutting mechanism 168: the retaining member 169 is rotated to the contrast position CP1, in contact with the web 154, while the cutting element 191 is moved with cutting of the web 154 (FIG. 5*a*) and definition of the terminal edge 181 of the web 144. The cutting also defines the initial edge 182 of the web 154 that is in turn retained by the suction holes of the hollow section member 204.

It is now activated the pair of pneumatic actuators RA2 (FIG. 6) causing the rotation of the retention member 171 to the contrast position CP2 with the retaining member 169 and pressing of the initial edge 184 with adhesive of the web 156 against the terminal edge 181 of the web 144 (FIG. 6*a*), carrying out the splicing of the web 144 to the web 156.

Figure 7A:
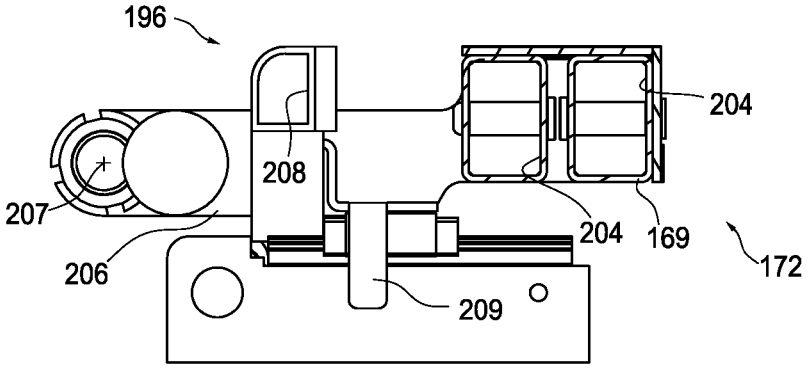
FIG. 7*a* is a schematic drawing in enlarged scale of a detail of FIG. 7.
Figure 7:
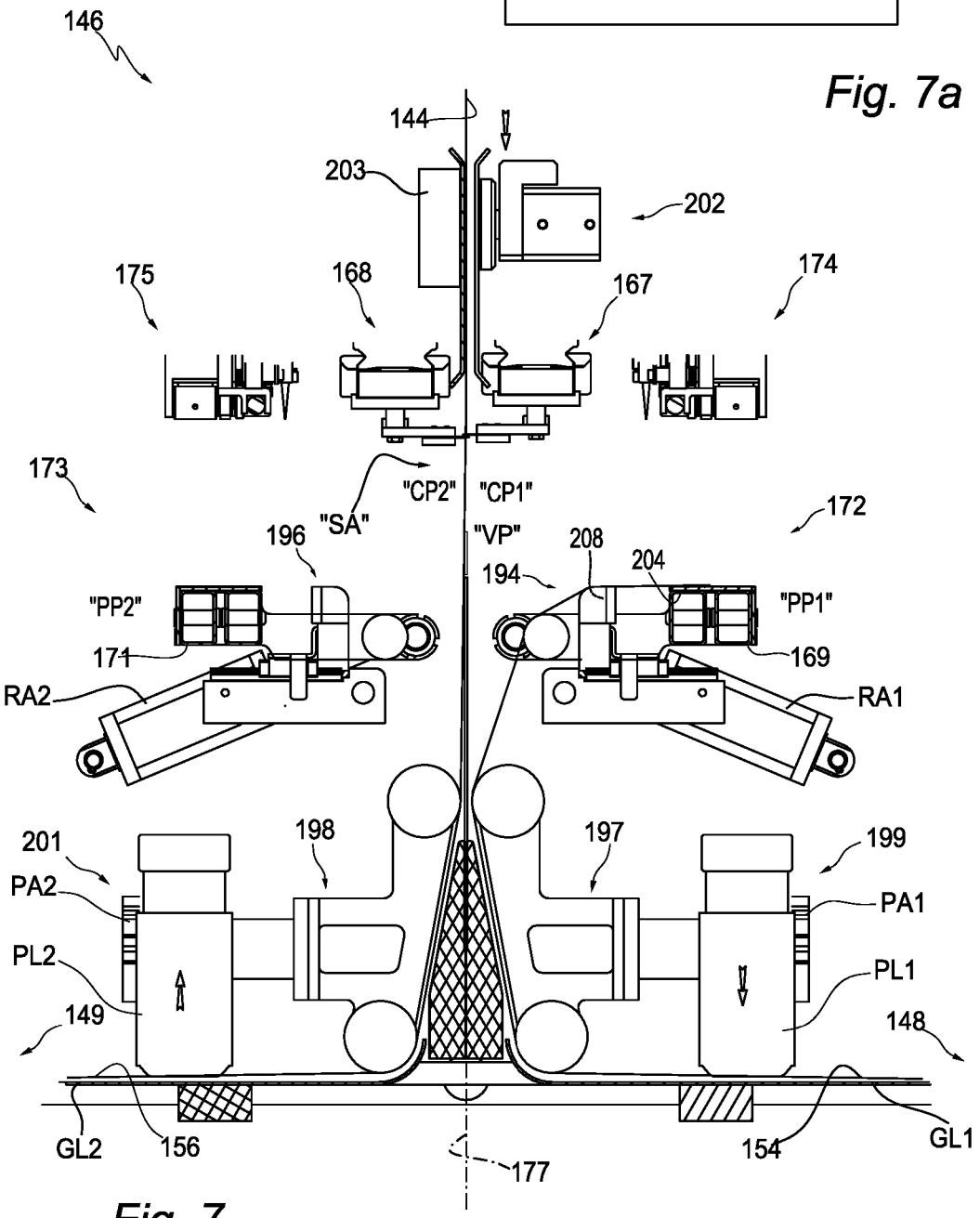

In sequence, the electronic control unit 153 puts the airtight chamber of the retention member 171 to ambient pressure and activates the pair of actuators RA2 so as to return the retaining member 171 (FIG. 7) to position PP2. The airtight chamber of the retaining member 169 (FIG. 7*a*) is brought to ambient pressure, maintaining the airtight chamber of the displacement member 196 under vacuum and the pair of actuators RA1 is activated, whereby returning the retaining member 169 to the predisposition position PP1.

The control unit 153 now moves the edge shifting member 194 in its operating position (FIGS. 7 and 8), dragging the edge 182 held back by the action of the vacuum. The recovery member 197 is moved to its recovery position, while, with movement completed, the edge shifting member 194 is returned to its rest position. The stopping mechanisms 201 and 202 are released and the second rewinding machine 149 is started for rewinding the second web 156 on the coil 152. The control unit 153 also activates the applying device 174 for applying the biadhesive film or a layer of glue to the initial edge 182 of the web 154 retained by the retaining member 169 in a manner similar to that described in the aforementioned Patent No. 1,428,679.

Figure 8A:
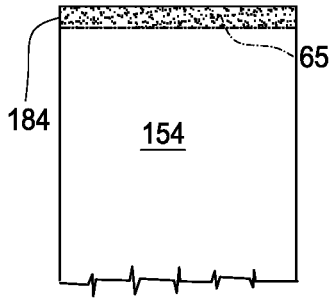
FIG. 8 is a schematic view of the equipment of FIG. 4 in a fifth operating configuration and FIG. 8*a* is a view of a web of FIG. 8.
Figure 8:
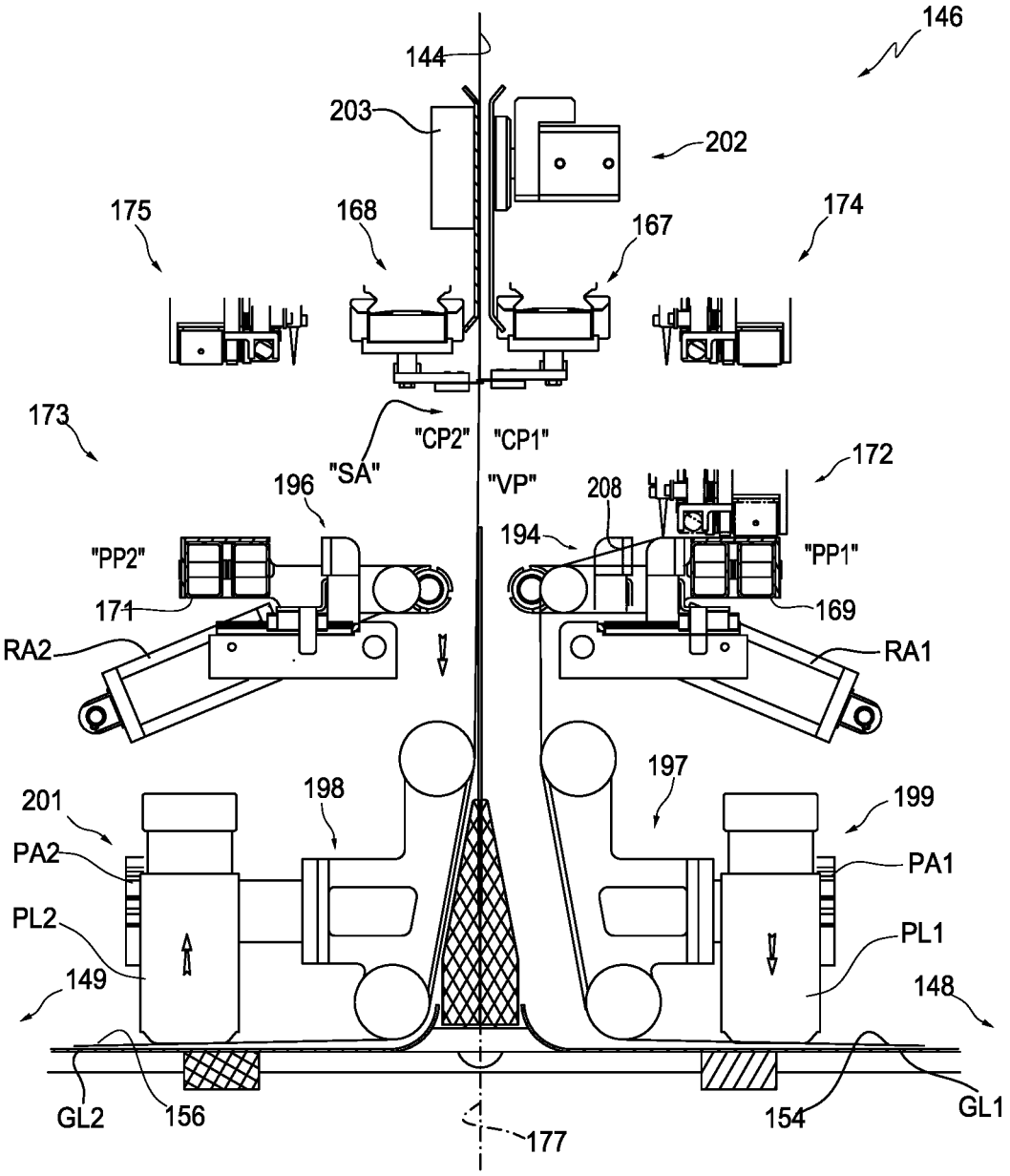

In this switched configuration of FIG. 8, the first rewinding machine 148 is arrested and waiting and the web 154 is ready for a junction to the incoming web 144, while the second rewinding machine 149 is operative and rewinds the web 156. In the splicing groups 172 and 173, the retaining members 169 and 171 are in the respective predisposition positions PP1 and PP2 and the stopping mechanism 199 blocks the web 154. The retaining member 169 retains, by action of the vacuum, the initial edge 182 of the first web 154 with the adhesive and is predisposed for the junction, while the retaining member 171 is inactive and free. In the splicing group 172, the edge shifting member 196 is in the rest position, the recovery member 197 is in its operative position while, in the splicing group 173, the edge shifting member 196 and the recovery member 198 are in the respective rest positions.

Upon receipt of another work order for prints on the web 144 concerning the sections S1 with the reference technology, to be added on the web 154, the electronic control unit 153 stops the second rewinding machine 149 and activates the pneumatic pads PL2 and PL3 with blocking of the webs 156 and 144 (FIG. 9) in the predefined and controlled position with respect to the area of junction SA. The control unit 153 activates the pair of pneumatic actuators RA2 and the pneumatic cylinder of the cutting mechanism 167: the retaining member 171 is rotated to the contrast position CP2, in contact with the web 156, while the cutting element 191 is moved with cutting of the web 156 (FIG. 9*a*) and definition of the terminal edge 181 of the web 144. The cutting also defines the initial edge 184 of the web 156, which is in turn retained by the suction holes of the hollow section member 204.

The actuators RA1 (FIG. 6) are now activated with rotation of the retaining member 169 to the contrast position CP1 against the retaining member 171 and pressure of the initial edge 182 with the adhesive film 154 against the terminal edge 181 of the web 144 (FIG. 10*a*), carrying out the splicing of the web 144 to the web 154.

The electronic control unit 153 puts the airtight chamber of the retention member 172 to ambient pressure and activates the pair of actuators RA2 so as to return the retaining member 171 (FIG. 4) to the predisposition position PP2. The stopping mechanisms 199 and 202 are released and the first rewinding machine 148 is activated for rewinding the first web 154 on the spool 151.

The control unit 153 now puts the airtight chamber of the retention member 171 to ambient pressure, maintaining the airtight chamber of the edge shifting member 196 under vacuum and actives the pair of actuators RA2, returning the retaining member 171 to the predisposition position PP2. The control unit 153 now moves the edge shifting member 196 to its operating position by dragging the edge 184 retained by the action of the vacuum. The recovery member 198 is moved to its recovery position, while, after the end of the movement, the edge shifting member 196 is returned to its rest position. The device 175 is also activated for applying the adhesive film or a layer of glue to the initial edge 184 of the web 156 retained by the retention member 171 in a manner similar to that described in the aforementioned Patent No. 1,428,679.

The configuration is now the one of reference in which the first rewinding machine 148 is operative and rewinds the web 154, while the second rewinding machine 149 is arrested and the web 156 on the output coil 152 is ready for a junction with the incoming web 144. This is signaled by the green light of the traffic lights 178 and 179.

The operation of the splicing and rewinding installation 28 as above described is, in substance, cyclical, for example for the formation of web coils with homogenous typologies, but it also applies to the events in which, after the switching of the installation to the switched configuration, the installation returns to the reference configuration.

This is the case when anomalous but temporary conditions of the web 144 are detected. The system wraps the defective sectors on the waiting coil and returns to the reference configuration with the restoring of the normal conditions. This is signaled for example by the lighting of the white light of the traffic light 178, 179, indicative of a request for intervention, from the switched side. Without interrupting the printing, the operator can replace the output coil 151, 152 with the sectors to be discarded, with an empty coil returning fully to the reference operative condition of.

In particular, the cyclic operation of the splicing and rewinding installation 28 occurs for defective sectors of the web 144 due to calibration and purge in ink jet printers and to the treatment of empty or defective sections of web emerging from the printing station.

The cyclic operation of the splicing and rewinding installation 28 also applies to the management of urgencies: upon detection of a priority working order, for example detected by reading the QR code or forced by the printing station 27, the control unit 153 stops the rewinding machine 148, 149, activates the switching of the output cutting and splicing equipment 146 for the modified configuration, with blocking of the web 154, 156 and 144, cutting and splicing of the web 144 to the web 156, 154 and starts the rewinding machine 149, 148.

Once the rewinding of the urgent work order is completed, the control unit returns the system 24 to the reference configuration with the web 144 added to the web 154, 156, starting of the rewinding machine 148, 149 and lighting the white light of the traffic light 178, 179, indicative of a request for intervention by the switched side. Also in this case, without stopping the printing, the operator can now remove the coil 151, 152 of the rewinding machine 148, 149 with the urgent work order for its immediate use, and replace it with an empty coil, restoring the full operation of the installation 28.

For the replacement of the output coils in conditions of full, the operation is the one already shown relating to the switching from reference condition to the modified condition of the splicing and rewinding installation 28.

In synthesis, upon receipt of the information on the condition of full of the rewinding machine 148, 149, with the specificities and constraints set by the terminal 176, the electronic control unit 153 stops the rewinding machine 148, 149, activates the switching of the output cutting and splicing equipment 146 with block of the web 154, 156 and 144, cutting of the web 144 and splicing to the web 156, 154, starts the rewinding machine 149, 148 and turns on the red light of the traffic light 178, 179. Without stopping of the printing, the operator can now remove the full coil 151, 152 of the rewinding machine 148, 149 for its use in the user system and replace it with an empty coil, restoring the full operation of the splicing and rewinding installation 28.

Figure 12:
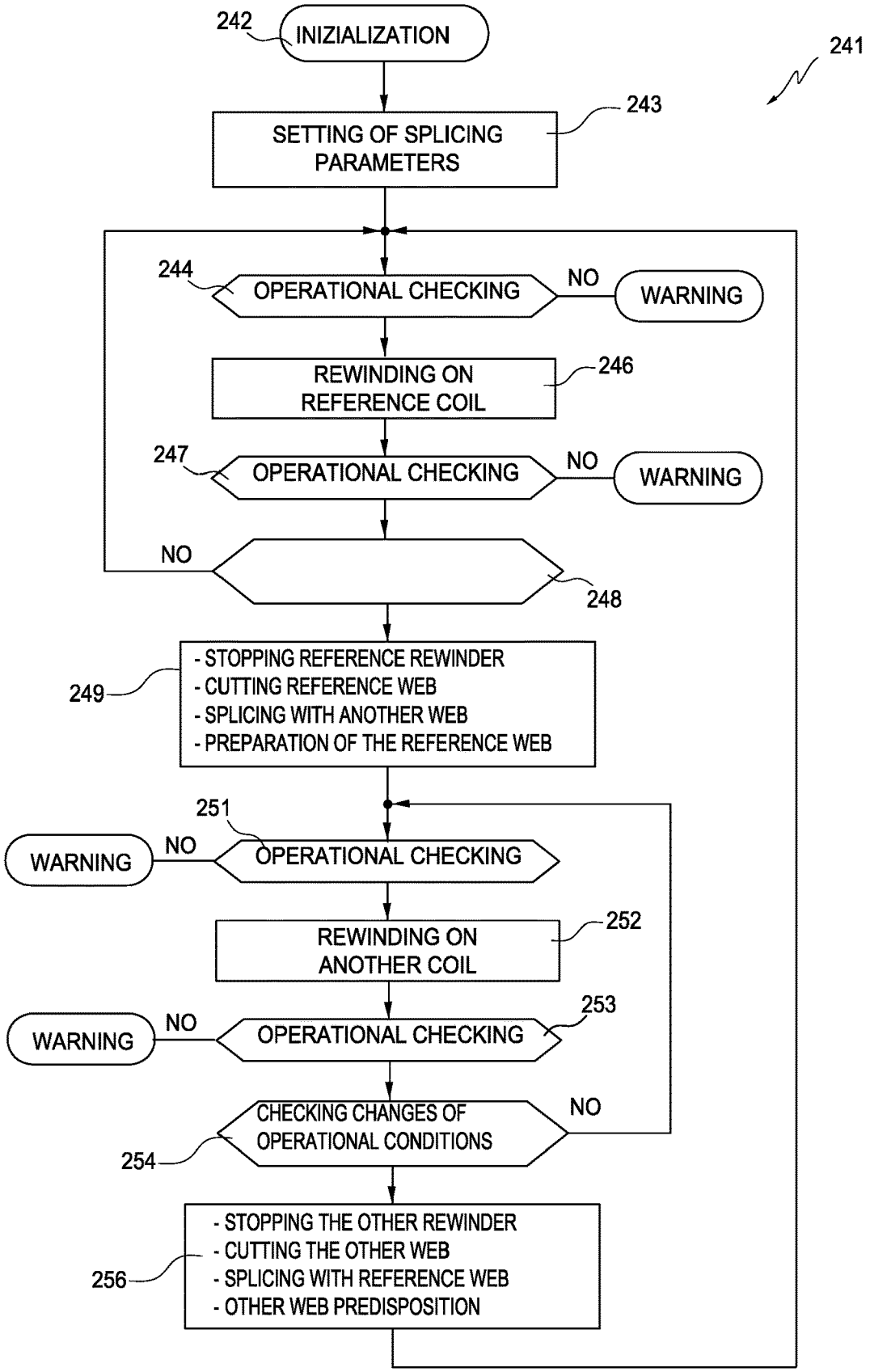
FIG. 12 is a block diagram of the method of high speed continuous digital printing, in accordance with the invention.

With reference to FIG. 12, the high speed digital printing method of the invention, represented with 241, therefore provides for an initialization step 242 in which the cores of the output coils 151 and 152 with the web sections 154 and 156 are loaded on the rewinding machines 148 and 149, the initial edges of the webs 154 and 156 are fixed on the splicing groups 172 and 173 of the output cutting and splicing equipment 146 and the edge of the web 154, 156 is added to the incoming web 144. It follows the setting of the parameters of junction, block 243, as regards the management of automatic junctions.

Verified in the decision block 244 that the system 24 is operative, it follows the rewinding of the incoming web 144 as web 154, 156, block 246, on the coil 151, 152 of the rewinding machine of reference 148, 149. Verified the correct operation of the system in the decision block 247, the process continues with the rewinding of the web 154, 156, checks 244 and block 246 until, at a decision block 248, a modified operating condition (from the reference condition) of the splicing and rewinding installation 28 is detected. In block 249, the electronic control unit 153 stops the reference rewinding machine 148, 149 and switches the output cutting and splicing equipment 146 in the switched configuration with cutting of the reference web 154, 156, splicing of the incoming web 144 with the other web 156, 154 and preparation of the reference web 154, 156 for a new junction.

After checking the operation of the system 24 at the decision block 251, it follows the rewinding of the incoming web 144, block 252, as web 156, 154 on the coil 152, 151 of the other rewinding machine 149, 148. Once the operation of the system has been verified at the decision block 253, the process continues with the rewinding of the web 156, 154 on the coil 152, 151, block 252, until, at decision block 254 another modified operating condition (from the modified condition) is detected. Finally, in block 256, the control unit 153 stops the other rewinding machine 149, 148 and performs a new switching of the output cutting and splicing equipment 146 to the reference configuration with cutting of the other web 156, 154, splicing of the incoming web 144 with the reference web 154, 156 and preparation of the other web 156, 154 for a new junction.

The principle of the invention remaining the same, the embodiment and the details of construction of the system and the method of digital printing at high speed for a continuous web can broadly be widely varied with respect to what has been described and illustrated, by way of non-limitative example, without by this departing from the ambit of the present invention.

In particular, the web rewinding system of the invention can effectively operate off line from a printing station on an incoming web coming from a previously printed web coil fed by an unwinding machine.

In this case, the splicing and rewinding installation comprises two rewinding machines for two output coils and an output cutting and splicing equipment arranged upstream of the rewinding machines. The cutting and splicing equipment is provided for cutting and splicing between the incoming web and the web of the output coils and alternate feeding of the output coils as an operative coil and a waiting coil, and in which the output cutting and splicing equipment and the rewinding machines can be switched between a reference configuration and a switched configuration. In the reference configuration, a first output coil is an operating coil and the second coil is a waiting coil while, in the switched configuration, the second output coil is an operating coil and the first coil is a waiting coil. The installation further comprises an electronic controller for activating the rewinding machines and the output cutting and splicing equipment, and in which the electronic controller responds to information associated with the incoming web and the splicing and rewinding installation for activating the switching of the output cutting and splicing equipment and the rewinding machines from the reference configuration to the switched configuration and, vice versa, from the switched configuration to the reference configuration. The incoming webs have sectors with a reference typology and a modified typology and the information associated with the incoming web relates to the reference typology and the modified typology, while the electronic controller is provided for switching the functionality of the rewinding machines and the output cutting and splicing equipment between the reference configuration and the switched configuration in response to information on the reference typology and the modified typology.

For the off line operation, the method of rewinding the incoming web uses a rewinding installation comprising an output cutting and junction equipment and two rewinding machines with two respective output coils. The installation comprises an electronic control unit for the rewinding machines and the output cutting and junction equipment and in which the electronic control unit responds to information associated with the incoming web and/or the rewinding installation for activating a switching of the output cutting and junction equipment and the rewinding machines from a reference configuration to a switched configuration. In detail, the method comprises the steps:

(a) upon detection of modified operating conditions, activating the output cutting and junction equipment and switching the functionality of the rewinding machines from a reference configuration to a switched configuration, with setting of the output coils from an operating coil to a waiting coil;

(b) switching the functionality of the cutting and exit junction equipment from a reference configuration to a switched configuration in association with the switched configuration of the rewinding machines;

(c) upon detection of reference operating conditions, activating the output cutting and junction equipment and switching the functionality of the rewinding machines from the switched configuration to the reference configuration, with setting of the output coils from the waiting coil to the operating coil; and (d) switching the functionality of the output cutting and junction equipment from the switched configuration to the reference configuration in association with the reference configuration of the rewinding machines.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, as used herein, the terms "process" and/or "processor" should be taken broadly to include a variety of electronic hardware and/or software based functions and components (and can alternatively be termed functional "modules" or "elements"). Moreover, a depicted process or processor can be combined with other processes and/or processors or divided into various sub-processes or processors. Such sub-processes and/or sub-processors can be variously combined according to embodiments herein. Likewise, it is expressly contemplated that any function, process and/or processor herein can be implemented using electronic hardware, software consisting of a non-transitory computer-readable medium of program instructions, or a combination of hardware and software. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A high-speed digital printing system for a continuous paper web comprising:

a web unwinding and splicing installation and a printing station, in which the unwinding and splicing installation includes two unwinding machines for two input web coils and an input cutting and splicing equipment and in which the input cutting and splicing equipment supplies, in turn, the printing station with the web of the two coils for printing on an outgoing web, said printing system further comprising a splicing and rewinding installation which includes an output cutting and splicing equipment, two rewinding machines with two respective output coils and an electronic controller, wherein, the output cutting and splicing equipment is constructed and arranged to receive the outgoing web from the printing station as an incoming web and can be activated for feeding the rewinding machines by cutting the incoming web and splicing the incoming web with a web of the two output coils without stopping printing, the output cutting and splicing equipment, and the rewinding machines are switchable between a reference configuration in which a first output coil is an operating coil and the second coil is a waiting coil and a switched configuration in which the second output coil is an operating coil and the first coil is a waiting coil, and wherein the electronic controller responds to an operative change of the system from a reference condition to a modified condition for switching the functionality of the output cutting and splicing equipment and of the rewinding machines from the reference configuration to the switched configuration and responds to an operative change of the system from the modified condition to the reference condition to restore the functionality of the output cutting and splicing equipment and of the rewinding machines to the reference configuration.

2. Digital printing system according to claim 1, wherein the incoming web defines sections with different typologies having sections with a reference typology and sections with a modified typology and includes information associated to said typologies and wherein the electronic controller responds to the information associated with said typologies for setting the output cutting and splicing equipment and the rewinding machines to the end of;

rewinding the incoming web having the section with the modified typology from a first operating coil on a second waiting coil, and setting the rewinding machine with the second coil for the functionality as operating coil and the rewinding machine with the first coil for the functionality as waiting coil, and rewinding the incoming web having the section with the reference typology from the second coil to the first coil, by re-setting the rewinding machine with the first coil as operating coil and the rewinding machine with the second coil as waiting coil.

3. Digital printing system according to claim 2, wherein the information associated to the typologies of said sections is obtained from machine readable codes printed by the printing station on the input web.

4. Digital printing system according to claim 1, wherein the electronic controller is provided for setting the output cutting and splicing equipment and switching the rewinding of the web from the operating coil to the waiting coil on reaching a full condition of the operating coil.

5. Digital printing system according to claim 4, wherein said system further comprises means for setting a joining distance from a full state of the output coils and in which the incoming web includes sectors without prints while the electronic controller is provided for setting the output cutting and splicing equipment and switching the rewinding of the web from the operating coil to the waiting coil, for the full condition, in correspondence of the sector without prints lying downstream of the joining distance.

6. Digital printing system according to claim 1, wherein the electronic controller responds to orders for urgent work for setting the output cutting and splicing equipment and switching the functionality of the rewinding machines from activities for ordinary printing to activities for rewinding the webs for urgent work and for returning to activities for ordinary printing upon completion of the urgent work.

7. Digital printing system according to claim 1, wherein the electronic controller responds to abnormal conditions for setting the output cutting and splicing equipment and switching the functionality of the rewinding machines from activities for ordinary printing to activities for anomalous webs and for returning to activities for ordinary printing upon completion of the abnormal conditions.

8. Digital printing system according to claim 1, wherein the incoming web has splicings effected by the input cutting and splicing equipment, and wherein the electronic controller is provided for setting the output cutting and splicing equipment and switching the functionality of the rewinding machines for the execution of splicings in synchronism with the splicings effected by the input cutting and splicing equipment.

9. Digital printing system according to claim 1, wherein the electronic controller conditions the setting of the output cutting and splicing equipment and the switching of functionality of the rewinding machines to splicing parameters to be manually or remotely set.

10. Digital printing system according to claim 1, wherein the output cutting and splicing equipment receives the incoming web from a rewinding buffer downstream of the printing station and comprises a cutting mechanism for the incoming web, an input stopping mechanism actuatable for stopping the incoming web during cutting and splicing operations, a first and a second bonding device and a first and a second splicing group with a respective retaining member for retaining, after cutting and separating and in preparation of a splicing, an initial edge of the first coil or, respectively, for retaining, after separation, an initial edge of the second coil; and in which the first bonding device and the second bonding device can be selectively actuated for automatically depositing an adhesive or a double-sided adhesive film on the initial edge of the first coil or of the second coil.

11. Digital printing system according to claim 1, further comprising a terminal for performing manual settings of splice parameters for the splicing and rewinding installation and said electronic is provided for forcing the switching between the reference configuration and the switched configuration in response to said manual settings.

12. Digital printing system according to claim 1, wherein said terminal comprises a touch screen with specific areas activable for setting said splice parameters.

13. Splicing and rewinding installation according to claim 1, wherein the electronic controller is provided for switching the rewinding of the incoming web on the waiting coil in response to warning signals associated with empty pages or unusable printouts.

14. A high-speed digital printing method for continuous web with cutting and splicing in two coils, in which said method uses a digital printing system comprising two unwinding machines with two feeding coils of input webs, an input cutting and splicing equipment and a printing station, and in which the input cutting and splicing equipment feeds, in turn, the printing station with the web of the two coils for printing on an outgoing web, wherein said printing system further comprises an output cutting and splicing equipment, two rewinding machines with two respective output coils, and electronic means for detecting reference operating conditions or modified operating conditions of the system, wherein said output cutting and splicing equipment receives the outgoing web from the printing station as an incoming web for feeding the rewinding machines by cutting the incoming web and splicing the incoming web with a web of the two output coils and in which said printing method includes the steps:

(a) upon detection of the modified operating conditions of the system, activating the output cutting and splicing equipment and switching the functionality of the rewinding machines from a reference configuration to a switched configuration without stopping the printing, with setting of the output coils from operating coil to waiting coil;

(b) switching the functionality of the output cutting and splicing equipment from a reference configuration to a switched configuration in association with the switched configuration of the rewinding machines;

(c) upon detection of the reference operating conditions, activating the output cutting and splicing equipment and switching the functionality of the rewinding machines from the switched configuration to the reference configuration, with setting of the output coils from waiting coil to operating coil; and (d) switching the functionality of the output cutting and splicing equipment from the switched configuration to the reference configuration in association with the reference configuration of the rewinding machines.

15. A high-speed splicing and rewinding installation for an incoming continuous paper web, comprising two rewinding machines for two output coils and an output cutting and splicing equipment arranged upstream of the rewinding machines, in which the cutting and splicing equipment is provided for cutting and splicing between the incoming web and the web of the output coils and alternate feeding of the output coils as an operative coil and a waiting coil, and in which the output cutting and splicing equipment and the rewinding machines can be switched between a reference configuration and a switched configuration, in which, in the reference configuration, a first output coil is an operating coil and the second coil is a waiting coil while, in the switched configuration, the second output coil is an operating coil and the first coil is a waiting coil; the installation comprising:

an electronic controller for activating the rewinding machines and the output cutting and splicing equipment; and the electronic controller responds to information associated with the incoming web and the splicing and rewinding installation for activating the switching of the output cutting and splicing equipment and the rewinding machines from the reference configuration to the switched configuration and, vice versa, from the switched configuration to the reference configuration, wherein the incoming webs have sectors with a reference typology and a modified typology and the information associated with the incoming web relates to the reference typology and the modified typology, and wherein the electronic controller is provided for switching the functionality of the rewinding machines and the output cutting and splicing equipment between the reference configuration and the switched configuration in response to information on the reference typology and the modified typology.

16. Splicing and rewinding installation according to claim 15, further comprising means for locally or remotely setting a filling limit of the coils associated with the full condition and in which the electronic controller is provided for switching the functionality of the rewinding machines and the output cutting and splicing equipment so as to rewind the web from an operating coil to a waiting coil on reaching the said filling limit of the operating coil.

17. Splicing and rewinding installation according to claim 15, wherein the information associated with the incoming web is obtained from codes printed on the incoming web and machine-readable.

18. Splicing and rewinding installation according to claim 15, wherein the sections with the reference typology relate to print pages for ordinary activities and the sections with the modified typology relate to print pages for urgent activities and/or bad sectors.

19. Splicing and rewinding installation according to claim 15, wherein the electronic controller conditions the setting of the output cutting and splicing equipment and the switching of functionality of the rewinding machines to splicing parameters which are manually or remotely settable.

20. Splicing and rewinding installation according to claim 15, wherein said installation is used as a rewinding equipment in a digital printing system for continuous paper web, said printing system comprising two unwinding machines with two input web input coils, an input cutting and splicing equipment, a printing station and an input buffer arranged upstream of the rewinding installation, in which the input cutting and splicing equipment supplies, in turn, the printing station with the continuous paper web of the two coils for printing on said continuous web and in which the switching of the output cutting and splicing equipment and the rewinding machines are performed without stopping of the printing station.

* * * * *